US011242685B2

(12) United States Patent
Pendley et al.

(10) Patent No.: US 11,242,685 B2
(45) Date of Patent: Feb. 8, 2022

(54) ROOFTOP-MOUNTABLE LOAD SUPPORT STRUCTURE WITH ADAPTER PLUG(S)

(71) Applicant: T&M Inventions, LLC, McFarland, WI (US)

(72) Inventors: Timothy Pendley, Madera, CA (US); Michael J. McLain, McFarland, WI (US)

(73) Assignee: T&M Inventions, LLC, McFarland, WI (US)

( * ) Notice: Subject to any disclaimer, the term of this patent is extended or adjusted under 35 U.S.C. 154(b) by 58 days.

(21) Appl. No.: 16/727,249

(22) Filed: Dec. 26, 2019

(65) Prior Publication Data

US 2021/0198892 A1 Jul. 1, 2021

(51) Int. Cl.

| | |
|---|---|
| ***E04D 13/00*** | (2006.01) |
| ***E04D 1/06*** | (2006.01) |
| ***E04D 1/00*** | (2006.01) |
| ***E04D 3/367*** | (2006.01) |
| ***E04D 13/17*** | (2006.01) |
| ***E04D 13/03*** | (2006.01) |
| ***E04D 1/26*** | (2006.01) |

(52) U.S. Cl.

CPC ..... *E04D 13/00* (2013.01); *E04D 1/06* (2013.01); *E04D 1/265* (2013.01); *E04D 1/29* (2019.08); *E04D 3/364* (2013.01); *E04D 13/0305* (2013.01); *E04D 13/17* (2013.01)

(58) Field of Classification Search

CPC .. E04D 13/00; E04D 1/06; E04D 1/29; E04D 3/364; E04D 1/265

See application file for complete search history.

(56) References Cited

U.S. PATENT DOCUMENTS

| | | | | |
|---|---|---|---|---|
| 3,521,414 | A * | 7/1970 | Malissa | E04D 13/031 52/107 |
| 4,559,753 | A * | 12/1985 | Brueske | E04D 13/031 52/200 |
| 5,778,628 | A | 7/1998 | Pendley | |
| 6,226,945 | B1 | 5/2001 | Henry et al. | |
| 7,069,704 | B2 | 7/2006 | Pendley | |
| 7,712,279 | B2 * | 5/2010 | McClure | E04D 13/0315 52/580 |
| 8,061,092 | B2 * | 11/2011 | McClure | E04D 3/364 52/200 |
| 8,397,468 | B2 * | 3/2013 | McClure | E04D 3/28 52/745.15 |
| 8,438,800 | B2 | 5/2013 | McLain et al. | |

(Continued)

*Primary Examiner* — Andrew J Triggs

(74) *Attorney, Agent, or Firm* — Stephen C. Jensen; Northwind IP Law

(57) ABSTRACT

Load support structures for mounting a load atop a raised rib metal panel roof make use of relatively small, inexpensive, and easy-to-make adapter plugs as interfaces between the raised ribs and one or more component pieces or members of the load support structure, such as an upper diverter or a lower closure member. The adapter plug has an inner surface and an outer surface, the inner surface having an inner profile substantially matching or conforming to some or all of the profile of a particular style of rib profile. The outer surface of the adapter plug has a standardized shape, some or all of which is made to conform to an upper diverter, lower closure, and/or other component member of the load support structure.

21 Claims, 18 Drawing Sheets

(56) References Cited

U.S. PATENT DOCUMENTS

| | | | |
|---|---|---|---|
| 8,991,126 | B2 | 3/2015 | Pendley et al. |
| 9,032,671 | B1 | 5/2015 | Pendley et al. |
| 9,163,419 | B2 | 10/2015 | Pendley |
| 9,290,937 | B2 | 3/2016 | Pendley et al. |
| 9,447,580 | B2 | 9/2016 | Points et al. |
| 9,534,390 | B2 | 1/2017 | Pendley et al. |
| 9,631,381 | B2 | 4/2017 | McLain |
| 9,725,916 | B2 | 8/2017 | McLain et al. |
| 9,784,003 | B2 | 10/2017 | Pendley et al. |
| 10,352,048 | B2 | 7/2019 | Pendley et al. |
| 2010/0162643 | A1 | 7/2010 | Blomberg et al. |
| 2015/0259936 | A1 | 9/2015 | Pendley et al. |
| 2021/0198892 | A1* | 7/2021 | Pendley ..... E04D 1/265 |

* cited by examiner

ROOFTOP-MOUNTABLE LOAD SUPPORT STRUCTURE WITH ADAPTER PLUG(S)

FIELD OF THE INVENTION

The present invention relates to metal roofs, with particular application to structures that are used to support loads on raised rib and standing seam metal panel roofs. The invention also pertains to related methods, systems, and articles.

BACKGROUND

Metal buildings with metal roofs have been used for many years for commercial, industrial, and warehousing applications. Such buildings are designed to have roof openings or penetrations for access hatches or for fans, air conditioning units, skylights, or other equipment or loads. Such loads are not mounted directly to the roof but to a "roof curb" or other load support structure which in turn mounts to the roof, or in some cases to structural members (subframes) inside the building and extend through the roof opening. Such load support structures provide features that direct water away from the roof opening, or that otherwise prevent water from entering the roof opening, and that suitably distribute the weight of the load, and also provide an uppermost rectangular frame-like flange on which the load can rest.

Various types of load support structures have been used, or proposed for use, on metal rooftops. Most common of these are traditional roof curbs with their associated subframes. Examples of alternative structures that mount on top of the roof are disclosed in U.S. Pat. No. 8,438,798 (McLain et al.), U.S. Pat. No. 9,228,354 (McClure), and U.S. Pat. No. 10,352,048 (Pendley et al.). Some of these structures extend between only two adjacent upstanding ribs of a metal panel roof. Other load support structures are twice as wide, extending from a first such rib, across a second rib, to a third rib, the second upstanding rib being between and parallel to the first and third ribs. In many cases (but not all cases), the nominal center-to-center spacing between adjacent ribs is 2 feet (24 inches), whereupon the double-wide load support structure would be 4 feet wide.

SUMMARY OF THE INVENTION

A variety of construction procedures and design features are used in the construction of metal buildings and roofs. In the case of raised rib or standing seam metal panel roofs, the profile shape of the raised rib or standing seam, or both, can vary significantly from one product line or manufacturer to another. For a given metal building or roof, this requires the various component pieces or members of the load support structure to be shaped or contoured in such a way as to conform to the particular profile shape of the raised ribs of the given roof.

We have identified an opportunity to simplify the installation process, and reduce inventory issues, for installers of roof curbs or other load support structures for raised rib roofs. The opportunity addresses the fact that a number of different types of raised rib profiles are in use today, and the desire to have as many component parts of the load support structure as possible be useable on any given roof regardless of the type of rib profile. Our disclosed solutions can not only make installation of the load support structure easier, but can provide a higher quality installation as well.

We have thus developed a new family of load support structures that utilize relatively small, inexpensive, and easy-to-make adapter plugs as interfaces between the raised ribs and one or more component pieces or members of the load support structure, such as an upper diverter or a lower closure member. The adapter plug has an inner surface and an outer surface, the inner surface having an inner profile substantially matching or conforming to at least part of the profile of a particular style of rib profile. The outer surface of the adapter plug has a standardized shape, which is made to conform to an upper diverter, lower closure, and/or other component member of the load support structure. An installer or builder may then carry or store a supply of different types of relatively small and inexpensive adapter plugs, each type characterized by an inner profile conforming to a particular type of raised rib profile, and an outer surface of a standardized shape. Upon arriving at a job site to install a load support structure for a skylight, fan, or other equipment, the installer can then select the appropriate type of adapter plug for the given rib profile, but then use standard upper diverter and/or lower closure components, for example, in the construction of the load support structure. Identical upper diverter or lower closure components can be used at other job sites on metal panel roofs having different raised rib profiles by simply selecting a different type of adapter plug whose inner profile conforms to such different raised rib profile.

We therefore disclose herein, among other things, load support structures for mounting loads on metal panel roofs in which elongate metal roof panels are arranged side by side, with edges of adjacent roof panels being joined to each other to define elevated roof panel ribs, and panel flats of the roof panels extending between adjacent ones of the elevated ribs, the roof panel ribs including a second roof panel rib disposed between a first and a third roof panel rib, the first, second, and third ribs all having a same rib profile. The load support structure includes: an upper diverter and a lower closure, each adapted to extend from the first rib to the third rib; a first side rail and a second side rail, each adapted to extend from the upper diverter to the lower closure; and a first adapter plug having a first outer surface and a first inner surface, the first outer surface having a first outer profile, and the first inner surface having a first inner profile. The upper diverter may include a lower flange, a first inclined element, a second inclined element, and an upstanding element, and the first and second inclined elements may each connect the lower flange to the upstanding element but on opposite ends of the upper diverter. The upper diverter may further include a first cover structure disposed between the first and second inclined elements, and the first cover structure may substantially conform to at least part of the first outer surface of the first adapter plug. The first inner profile of the first adapter plug may substantially conform to at least part of the rib profile.

The first outer surface may have one or more first edges and the first inner surface may have a plurality of second edges, the one or more first edges and the plurality of second edges being parallel to each other. The plurality of second edges may be greater in number than the one or more first edges. The first cover structure may include a first cover element and a second cover element with a gap therebetween, and the first adapter plug may include a first cap portion, and the first cap portion may extend through the gap. The first cap portion may define a first slot, and an edge of the first cover element may mate with the first slot. The first adapter plug may comprise rubber, Ultra High Molecular Weight (UHMW) polyethylene, or other suitable materials.

The upper diverter may include a first diverter member and a second diverter member, the first diverter member adapted to extend from the first rib to the second rib, and the second diverter member adapted to extend from the second rib to the third rib, the first diverter member including the first inclined element, and the second diverter member including the second inclined element. The first and second diverter members may be joined to each other by one or more mechanical fasteners. The first cover structure may include a first cover element and a second cover element, the first diverter member including the first cover element, and the second diverter member including the second cover element. The first and second cover elements may each be flat but not parallel to each other. The first and second cover elements may be oriented to define an included angle in a range from 80 to 100 degrees. The first and second cover elements may each extend in a direction perpendicular to the upstanding portion.

The load support structure may also include a second adapter plug having a second outer surface and a second inner surface, the second outer surface having a second outer profile, and the second inner surface having a second inner profile, and the lower closure may include a second cover structure, the second cover structure substantially conforming to at least part of the second outer surface of the second adapter plug, and the second inner profile of the second adapter plug may substantially conform to at least part of the rib profile. The second inner profile may be substantially the same as the first inner profile. The second outer surface of the second adapter plug may have one or more first edges and the second inner surface of the second adapter plug may have a plurality of second edges, the one or more first edges and the plurality of second edges being parallel to each other. The plurality of second edges may be greater in number than the one or more first edges.

The load support structure may also include: a third adapter plug having a third outer surface and a third inner surface, the third outer surface having a third outer profile, and the third inner surface having a third inner profile; and a fourth adapter plug having a fourth outer surface and a fourth inner surface, the fourth outer surface having a fourth outer profile, and the fourth inner surface having a fourth inner profile. The lower closure may include a third cover structure and a fourth cover structure, the third cover structure substantially conforming to at least part of the third outer surface of the third adapter plug, and the fourth cover structure substantially conforming to at least part of the fourth outer surface of the fourth adapter plug. The second inner profile may substantially conform to two sides of the rib profile, and each of the third and fourth inner profiles may substantially conform to only one side of the rib profile.

We also disclose load support structures that include: an upper diverter including a first diverter member and a second diverter member, the first diverter member adapted to extend from the first rib to the second rib and the second diverter member adapted to extend from the second rib to the third rib; a lower closure including a first closure member and a second closure member, the first closure member adapted to extend from the first rib to the second rib and the second closure member adapted to extend from the second rib to the third rib; a first side rail and a second side rail, each adapted to extend from the upper diverter to the lower closure; and a first adapter plug having a first outer surface and a first inner surface, the first outer surface having a first outer profile, and the first inner surface having a first inner profile. The first diverter element may include a first upstanding portion, a first inclined element, and a first cover element. The second diverter member may include a second upstanding portion, a second inclined element, and a second cover element. The first cover element in combination with the second cover element may substantially conform to at least part of the first outer profile of the first adapter plug, and the first inner profile of the first adapter plug may substantially conform to at least part of the rib profile.

We also disclose load support structures that include: a first transverse member and a second transverse member, each adapted to extend from the first rib to the third rib; a first side rail and a second side rail, each adapted to extend from the first transverse member to the second transverse member; and an adapter plug having an outer surface and an inner surface, the outer surface having an outer profile, and the inner surface having an inner profile. The first transverse member may include a cover structure that substantially conforms to at least part of the outer surface of the adapter plug, and the inner profile of the adapter plug may substantially conform to at least part of the rib profile. The first transverse member may be or include an upper diverter, and the second transverse member may be or include a lower closure.

We also disclose numerous related methods, systems, and articles.

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

The inventive articles, systems, and methods are described in further detail with reference to the accompanying drawings, of which.

In the figures, like reference numerals designate like elements.

DETAILED DESCRIPTION

We have developed load support structures that mate with one or more adapter plugs to allow for the standardization of other component members of the load support structure, such as an upper diverter or a lower closure of the load support structure, despite the number of different types of raised rib profiles in use today.

Figure 1:
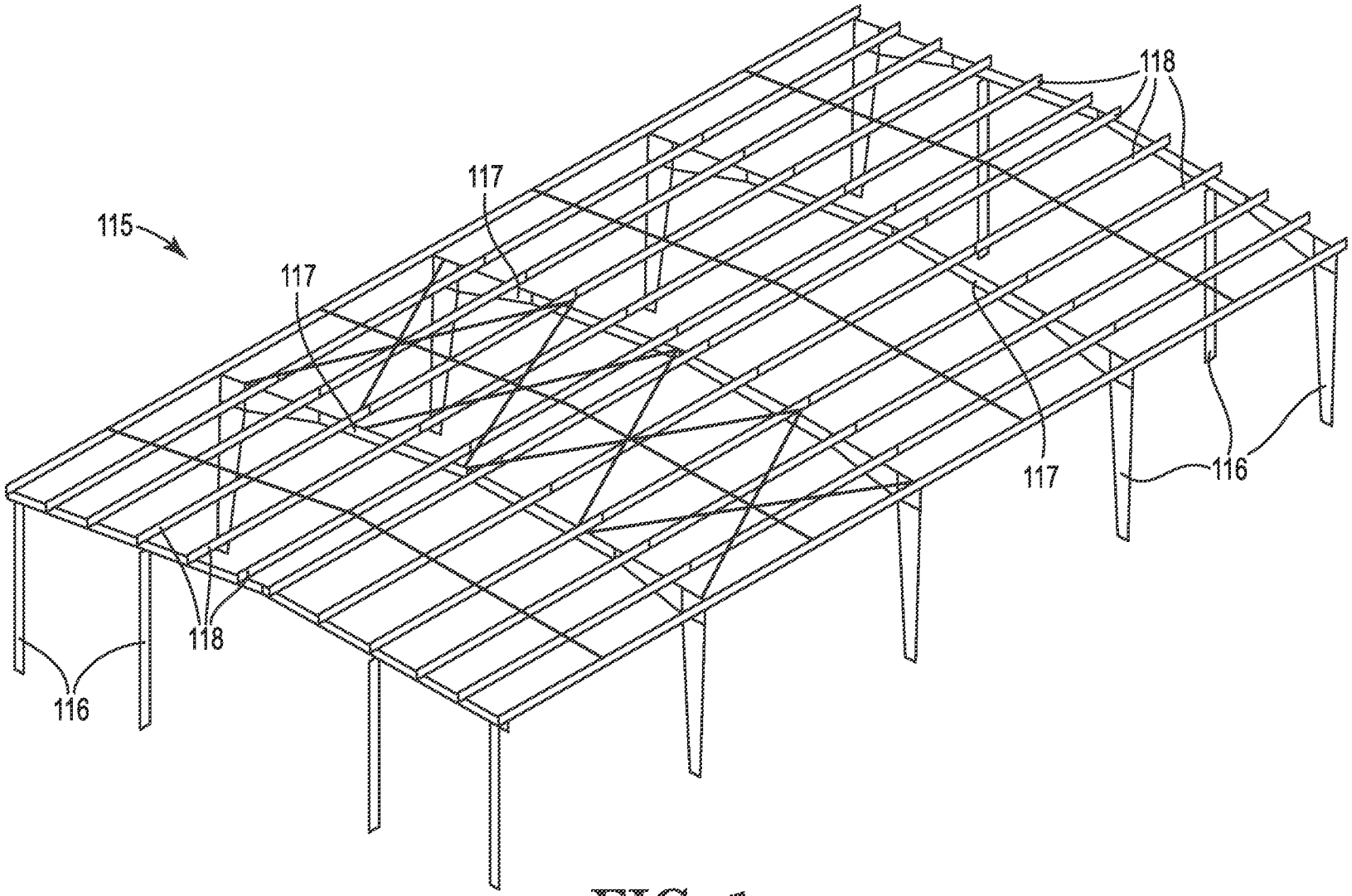
FIG. 1 is a schematic perspective view of an unfinished building atop which a raised rib metal panel roof may be added.

The framework of a metal building 115 suitable for supporting a metal roof as disclosed herein is shown in FIG. 1. Columns 116 rest on suitable footings, or on a concrete slab or other suitable foundation. The columns 116 support a series of beams or rafters 117 which are located at the roof level, and which are sloped to define the pitch of the roof. The columns 116 and rafters 117 are considered primary structural members. Affixed to the rafters 117 are regularly spaced secondary structural members (or secondary roof framing members) 118, such as purlins, bar joists, or the like. For ease of discussion through the remainder of this document, the secondary structural members will be referred to as purlins, with the understanding that any such purlin may be replaced with a suitable bar joist or other secondary structural member. The purlins 118 are perpendicular to the rafters 117 and may run the length of the building or roof. Center-to-center spacing of the purlins 118 is normally 5 feet, but can vary from one building design to another.

Figure 2A:
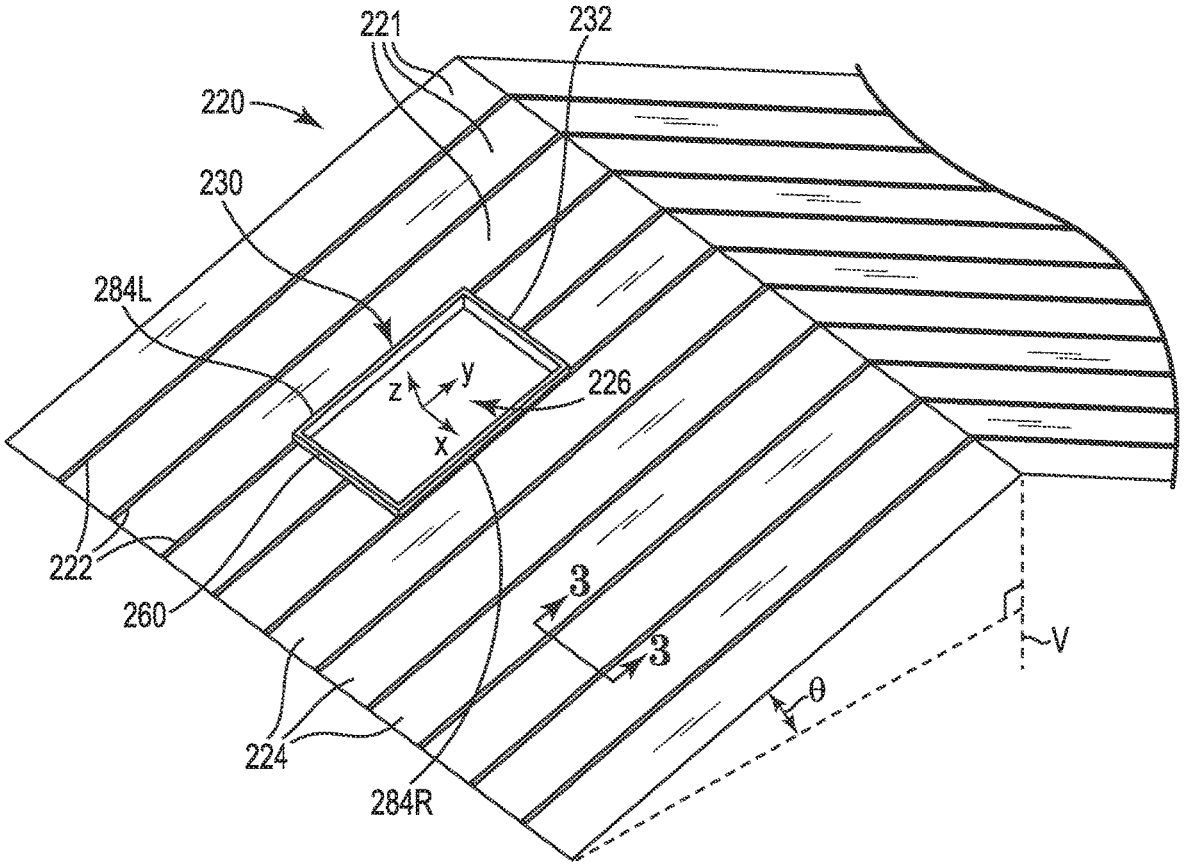
FIG. 2A is a schematic perspective view of a portion of a raised rib metal panel roof to illustrate a possible placement of a load support structure on the roof.

A schematic perspective view of a portion of a raised rib metal panel roof 220 is shown in FIG. 2A to illustrate a possible placement of a load support structure 230 on the roof. The roof 220 comprises a set of metal roof panels 221 that connect to each other along (at least) their longitudinal edges, referred to in the art as a side lap. The roof panels 221 are held in place by clips, screws, or other known attachment mechanisms to purlins 118, upon which the roof panels rest. Each roof panel 221 may extend from the bottom (cave) to the top (ridge) of the roof, except to the extent it may be interrupted by a roof opening or aperture, such as aperture 226. The roof panels 221 are typically made of aluminum/zinc-coated steel, and have a thickness in a range from 22-gauge to 29-gauge. The left and right longitudinal edges of each panel are roll-formed in such a way as to fit together or mate with edges of its adjacent roof panels 221, each mated pair of adjacent edges forming a raised rib 222. The ribs 222 rise above the level of the large central flat portion of each roof panel 221, which portion is referred to as a panel flat 224. (In some cases the panel flat portion of the roof panel is in fact substantially flat or planar, but in other cases it is mostly flat but includes some minor longitudinal bends to form one or more minor ribs, shorter in height than the raised ribs 222, for added stiffness and structural strength.) The ribs 222 are thus all nominally parallel to each other. The roof 220 is shown to be pitched at an angle θ relative to the horizontal, which angle is dictated by the pitch angle of the rafters 117 underlying the purlins 118 (which in turn underlie the roof panels 221).

A rectangular aperture 226 is formed in the roof by cutting away portions of the roof panels 221 without cutting into or damaging any of the underlying purlins 118. The longitudinal dimension of the aperture 226 may typically be less than 10 feet, but longer and shorter dimensions can also be used. The aperture 226 shown in FIG. 2 is a so-called double wide opening because it extends not just between two adjacent ribs 222, but from a first rib 222, across a second rib 222, to a third rib 222. The central (second) rib is completely severed or removed between the top and bottom edges of the opening 226. Since the nominal spacing between adjacent ribs 222 is typically 2 feet, the lateral dimension (width) of the opening 226 is typically 4 feet, but other dimensions are also possible.

On this roof 220, a load support structure 230 is mounted that completely frames the opening 226. The load support structure 230 rests atop the roof panels 221 and has four main parts corresponding to the four sides of the opening 226: a top part referred to as an upper diverter 232, a bottom part referred to as a lower closure 260, and left and right side parts referred to as a left side rail 284L and a right side rail 284R. These components will be discussed in further detail below. The load support structure 230 provides a base upon which a skylight, fan, air conditioning unit, or other piece of equipment or load can be mounted. The load support structure 230 suitably distributes the weight of the load to adjacent roof panels, and provides a watertight seal to prevent rainwater, melting snow, or the like from entering the building through the aperture 226. In some cases, the load support structure 230 can be mounted on a raised rib metal panel roof like that of roof 220 but where no aperture or opening is necessary, and none is formed, in the roof beneath the load support structure.

Figure 2B:
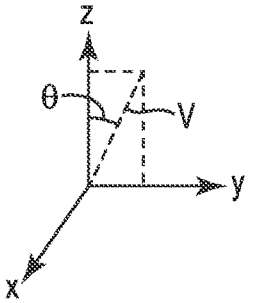
FIG. 2B is a schematic view of a coordinate system associated with a load support structure.

For convenience and reference, a Cartesian x-y-z coordinate system is defined in connection with the roof 220, the aperture 226, and the load support structure 230. The x-y plane defines the plane of the roof 220 (or at least the portion of the roof in the vicinity of the load support structure, as well as the plane of the aperture), with the positive y-direction pointing in the up-slope direction toward the roof ridge, and the negative y-direction pointing in the down-slope direction toward the roof cave. The x-axis extends perpendicular to the raised ribs 222 and parallel to the underlying purlins 118. The z-axis extends generally upward but perpendicular to the plane of the roof, and thus deviating from a purely vertical axis V by an amount equal to the pitch angle of the roof, θ. This relationship is illustrated in FIG. 2B, where the vertical axis V, which lies in the y-z reference plane, is separated from the z-axis by the same angle θ.

The cut line 3-3 in FIG. 2A is provided to illustrate in more detail possible configurations of the raised ribs 222 of the roof 220. Examples of a few such configurations are shown schematically in FIGS. 3A-3E. These figures are all oriented to lie in (or parallel to) the x-y plane, facing the positive y-direction.

Figure 3A:
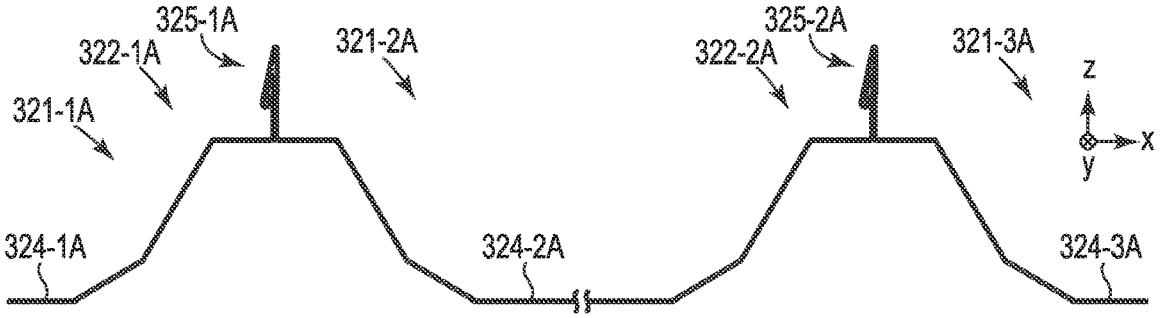
FIGS. 3A-3E are schematic end views or cross-sectional views of various raised rib profiles in current use in metal buildings.

FIG. 3A illustrates one version of a standing seam roof configuration. In this view, we see three roof panels 321-1A, 321-2A, and 321-3A, whose adjacent edge portions have been roll-formed and seamed to define two raised ribs 322-1A and 322-2A. The raised ribs include respective standing seams 325-1A and 325-2A. A standing seam is where the edge portions of two adjacent roof panels come into contact with each other and are crimped to form a generally "vertical" seam. (The seam is usually not oriented precisely vertically, i.e., in alignment with the vertical axis V, at least due to the nonzero pitch angle of the roof.) Adjacent to the raised ribs, the roof panels are substantially flat, forming panel flats 324-1A, 324-2A, and 324-3A as shown. Panel flat 324-2A, which is part of the roof panel 321-2A, separates the raised ribs 322-1A, 322-2A from each other.

Figure 3B:
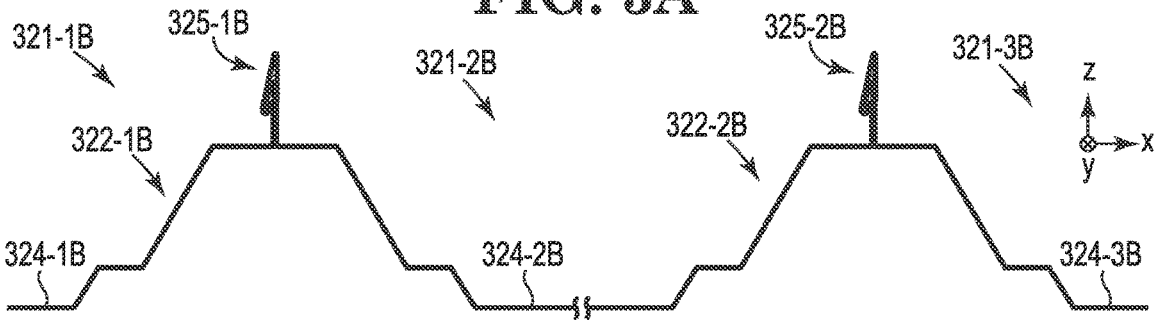

FIG. 3B illustrates another version of a standing seam roof configuration. Here, adjacent edge portions of three roof panels 321-1B, 321-2B, and 321-3B have been bent and crimped to define two raised ribs 322-1B and 322-2B. The raised ribs include respective standing seams 325-1B and 325-2B. Adjacent to the raised ribs, the roof panels are substantially flat, forming panel flats 324-1B, 324-2B, and 324-3B as shown. Panel flat 324-2B, which is part of the roof panel 321-2B, separates the raised ribs 322-1B, 322-2B from each other.

Figure 3C:
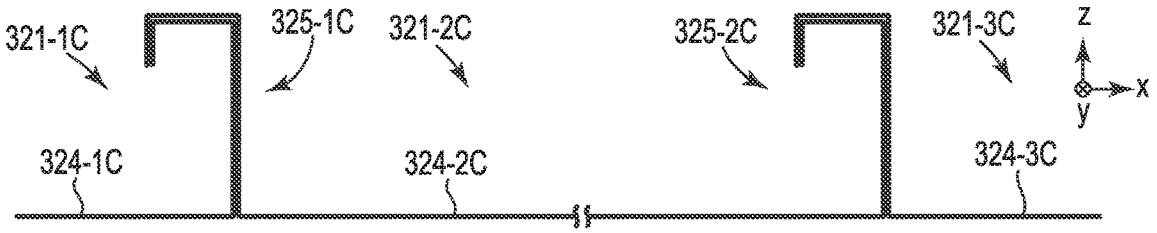

FIG. 3C illustrates a standing seam roof configuration known in the art as an architectural standing seam. Here, adjacent edge portions of three roof panels 321-1C, 321-2C, and 321-3C have been bent and crimped to define two standing seams 325-1C and 325-2C. Adjacent to these standing seams, the roof panels are substantially flat, forming panel flats 324-1C, 324-2C, and 324-3C as shown. Panel flat 324-2C, which is part of the roof panel 321-2C, separates the standing seams 325-1C, 325-2C from each other. The standing seams 325-1C, 325-2C may be loosely considered to be elevated roof panel ribs (raised ribs), and the roofing of FIG. 3C may be loosely considered to be a raised rib roof, because the standing seam provides the roof with a structural rigidity in similar fashion to a traditional raised rib.

Figure 3D:
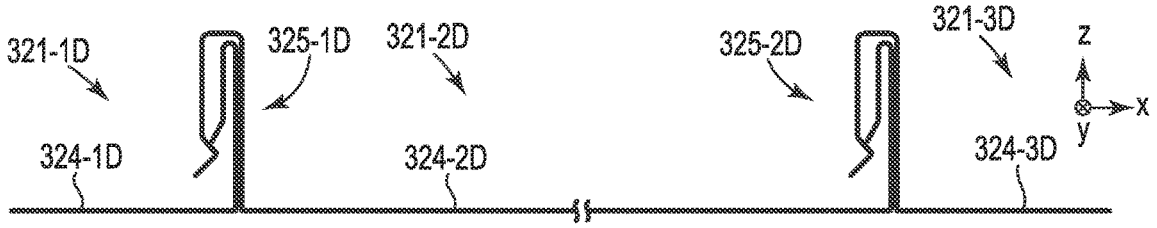

FIG. 3D illustrates a standing seam roof configuration known in the art as a snap seam rib. Here, adjacent edge portions of three roof panels 321-1D, 321-2D, and 321-3D have been bent and crimped to define two standing seams 325-1D and 325-2D. Adjacent to these standing seams, the roof panels are substantially flat, forming panel flats 324-1D, 324-2D, and 324-3D as shown. Panel flat 324-2D, which is part of the roof panel 321-2D, separates the standing seams 325-1D, 325-2D from each other. The standing seams 325-1D, 325-2D may be loosely considered to be elevated roof panel ribs (raised ribs), and the roofing of FIG. 3D may be loosely considered to be a raised rib roof, for the same reasons given in connection with FIG. 3C.

Figure 3E:
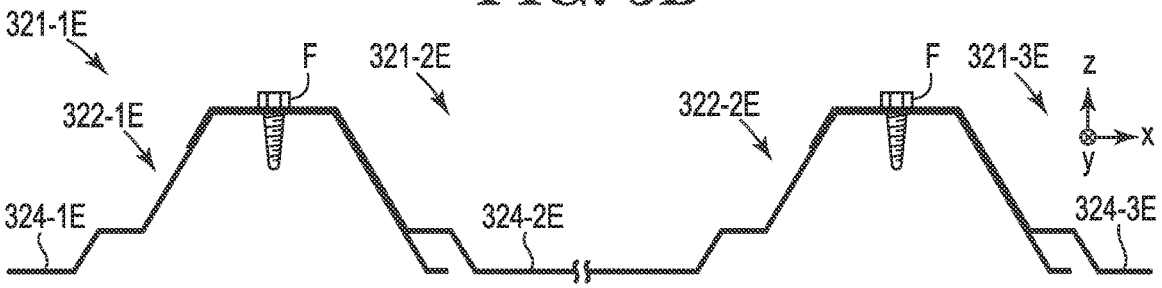

FIG. 3E illustrates a raised rib roof configuration known in the art as an R-panel roof. Unlike the roofs of FIGS. 3A-3D, this configuration contains no standing seams. Instead, adjacent edge portions of three roof panels 321-1E, 321-2E, and 321-3E are bent, overlaid, and secured together with fasteners F to form two raised ribs 322-1E, 322-2E. The fasteners F are repeated on a regular basis along the length of each raised rib. Adjacent to the raised ribs, the roof panels are substantially flat, forming panel flats 324-1E, 324-2E, and 324-3E as shown. Panel flat 324-2E, which is part of the roof panel 321-2E, separates the raised ribs 322-1E, 322-2E from each other.

Figure 4:
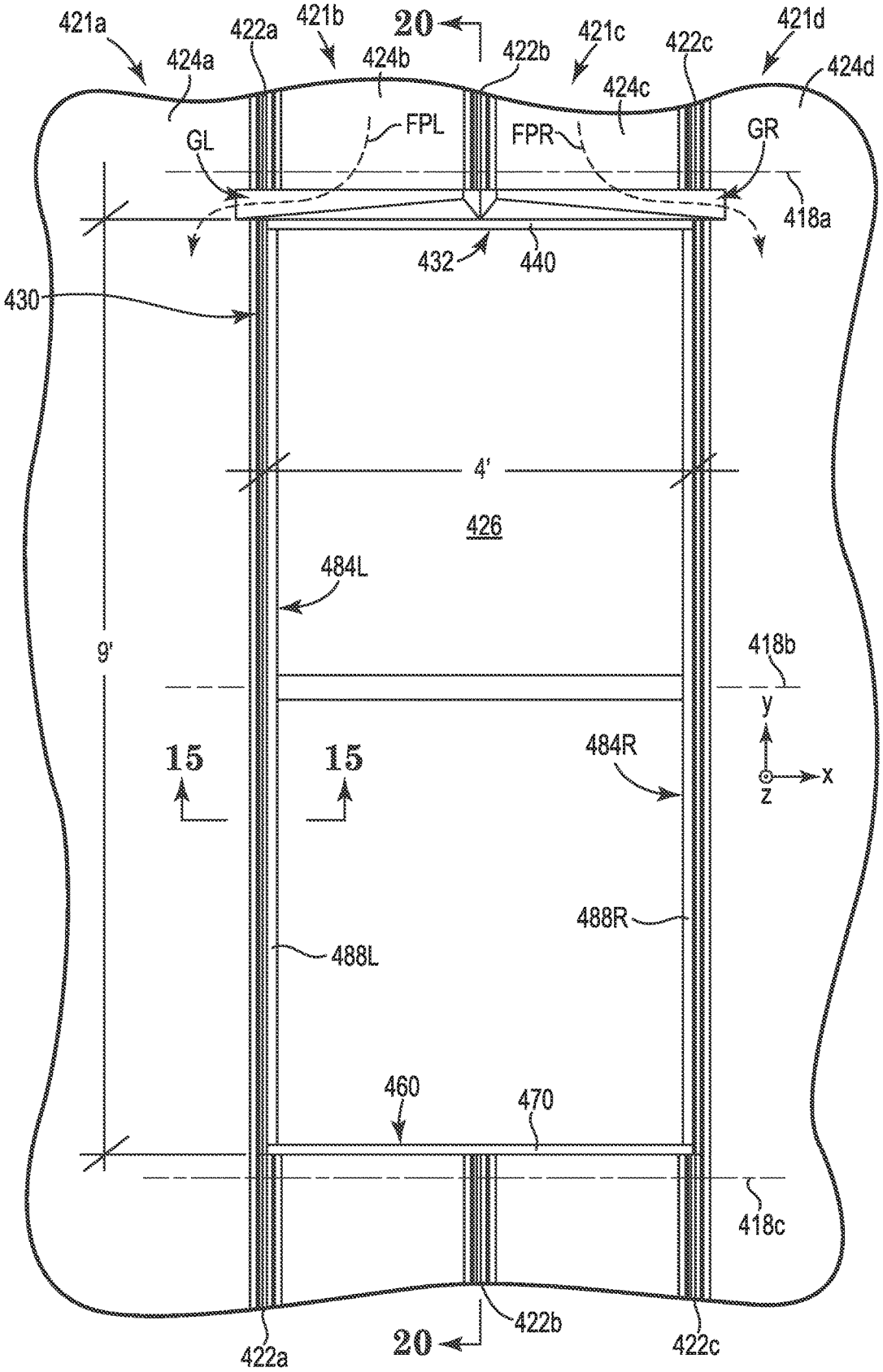
FIG. 4 is a schematic top view of a load support structure installed on a raised rib metal panel roof around a roof opening.

A schematic top view of a load support structure 430 installed on a raised rib metal panel roof like that of FIG. 2A is shown in FIG. 4. The structure 430 is installed on a raised rib metal panel roof having roof panels 421*a*, 421*b*, 421*c*, and 421*d*. The panels are configured to mate with each other along their edge portions to define raised ribs, including ribs 422*a*, 422*b*, and 422*c*. (The raised ribs may be or include standing seams, or they may include no standing seams, as discussed above in connection with FIGS. 3A-3E.) Between pairs of adjacent raised ribs are panel flats 424*a*, 424*b*, 424*c*, and 424*d*. A Cartesian coordinate system x-y-z is defined as before, with the x-y plane again being in or parallel to the plane of the roof, and the y-axis pointing in the up-slope direction. Portions of roof panels 421*b*, 421*c*, and portions of raised ribs 422*a*, 422*b*, 422*c*, have been cut away to define a generally rectangular aperture or opening 426. The opening 426 is located between two underlying purlins, represented by dashed lines 418*a* (upper purlin) and 418*c* (lower purlin), with an intermediate purlin, a portion of which is visible through the aperture 426, represented by dashed line 418*b*.

The load support structure 430 has four main components corresponding to the four sides of the rectangular opening: an upper diverter 432, a lower closure 460, a left side rail 484L, and a right side rail 484R. These components may be made of aluminum, steel, or other suitable metals or other rigid materials, and are connected to each other and to the underlying roof by mechanical fasteners such as screws, rivets, or other suitable fasteners as explained further below. The upper diverter 432 and the lower closure 460 each extend from a first rib (422*a*), across a second rib (422*b*), to a third rib (422*c*). The side rails 484L, 484R each extend from the upper diverter 432 to the lower closure 460 along and upon a given raised rib. A rectangular frame upon which a load may rest is provided by upper flanges 440 (of the upper diverter), 470 (of the lower closure), and 488L and 488R (of the side rails). The dimensions of the frame so formed may be 4 feet wide by 9 feet long, as shown in the figure. The load itself is not shown in FIG. 4. The load support structure 430 is preferably configured to distribute the weight of a load to adjacent roof panels, and provide a watertight seal to prevent rainwater, melting snow, or the like from entering the building through the aperture 426. The side rails 484L, 484R are preferably mounted directly to their respective underlying raised ribs 422*a*, 422*c* (a) along substantially an entire length of the load, or (b) along the entire length from lower closure 460 to upper diverter 432, or both (a) and (b), or neither (a) nor (b), to distribute the weight of the load as evenly as possible along these lengths.

As mentioned above, the load support structure 430 may, on the one hand, be of the type whose full weight is supported by the raised ribs and adjacent portions of the roof panels, with no sub-framing substructure, or on the other hand may be of the type whose weight is supported fully or substantially fully by a sub-frame beneath the roof panels. The adapter plugs described further below may be employed in either of these cases on a diverter and/or lower closure of the load support structure.

The upper diverter 432 is configured to divert water flowing down the panel flat 424*b* (up-slope from the opening 426) through a gap GL that was cut in the raised rib 422*a*, and from there downward along the panel flat 424*a*, as shown generally by flow path FPL. The upper diverter 432 is similarly configured to divert water flowing down the panel flat 424*c* (up-slope from the opening 426) through a gap GR that was cut in the raised rib 422*c*, and from there downward along the panel flat 424*d*, as shown generally by flow path FPR. The upper diverter 432 and the lower closure 460 each span and seal against the centrally located raised rib 422*b*, and thus must adapt to the profile shape of that rib. There need not be, and preferably is not, a perfect match of the profiles of the two parts, to provide a small gap or space therebetween to facilitate water-tight scaling by a suitable caulk, mastic, or other suitable sealant material. Of course, the rib profile (profile shape) of the rib 422*b* is nominally the same as that of ribs 422*b*, 422*c*.

Design details of the upper diverter, lower closure, and side rails will now be discussed in more detail.

Figure 5A:
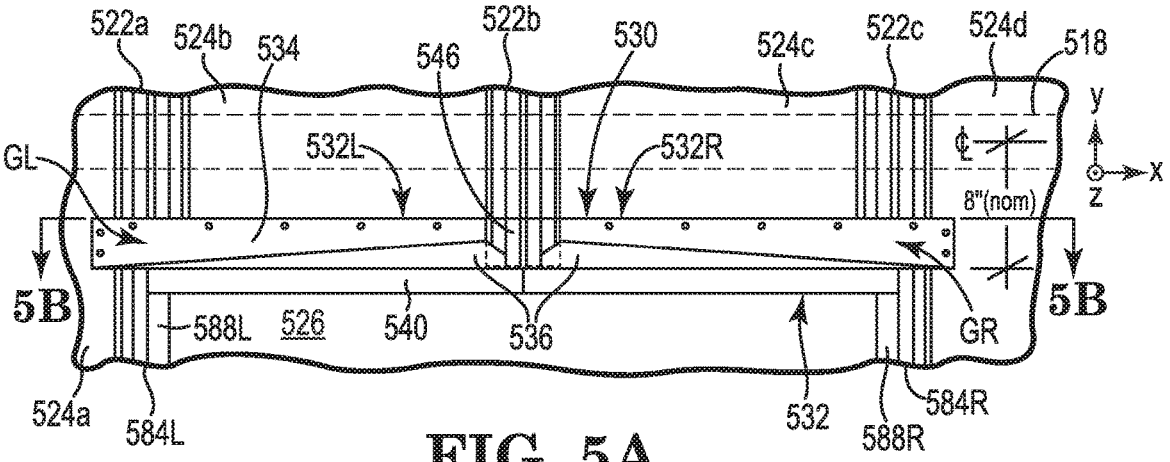
FIG. 5A is a schematic top view of a portion of a load support structure, and neighboring roof elements, in the vicinity of an upper diverter, the upper diverter being of a more conventional design representing standard practice.
Figure 5B:
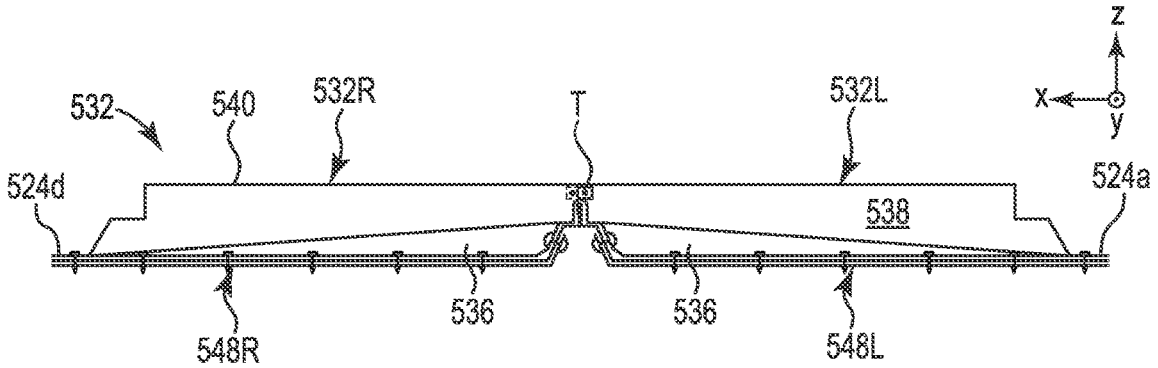
FIG. 5B is a schematic cross-sectional view along line 5B-5B in FIG. 5A.
Figure 5C:
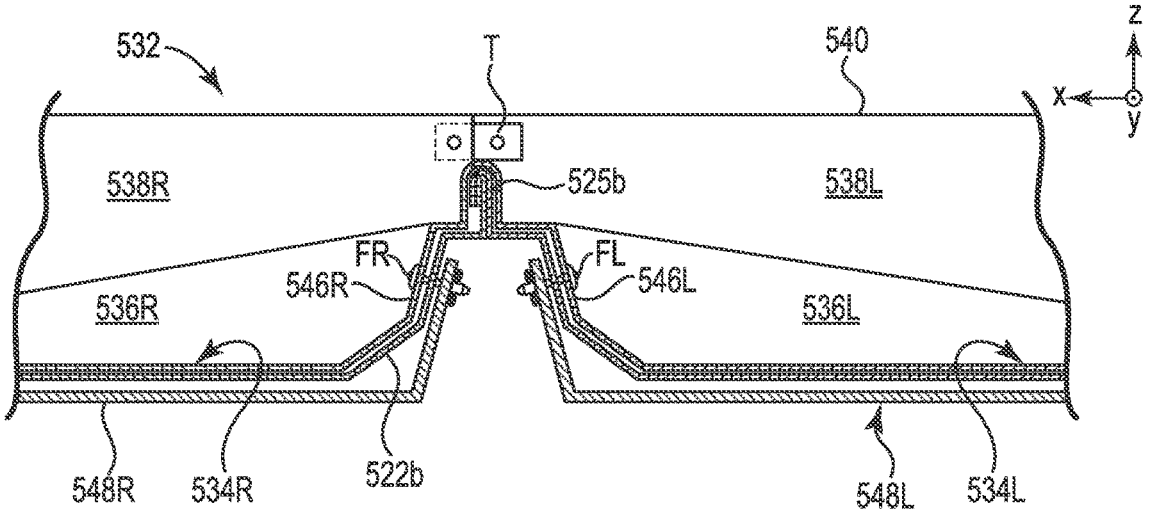
FIG. 5C is a magnified portion thereof.

FIGS. 5A through 5C show various schematic views of an upper diverter 532 and neighboring elements of a load support structure 530 and roof, where, for comparison purposes, the upper diverter 532 does not make use of the adapter plugs disclosed herein. FIG. 5A is a top view looking in the direction of the negative z-axis, whereas FIG. 5B is a front view looking in the direction of the negative y-axis (down-slope), and FIG. 5C is a magnified portion of FIG. 5B. Elements in these figures that have the same reference number refer to the same part, component, or feature.

The load support structure 530 is mounted on a raised rib metal panel roof like that of FIGS. 2A and 4. The metal panel roof has roof panels configured to mate with each other along their edge portions to define raised ribs, including ribs 522*a*, 522*b*, and 522*c*. Between pairs of adjacent raised ribs are panel flats 524*a*, 524*b*, 524*c*, and 524*d*. A Cartesian x-y-z coordinate system is defined as before, with the x-y plane being parallel to the plane of the roof and the y-axis pointed in the up-slope direction. Portions of the roof panels and raised ribs have been cut away to define an aperture or opening 526, the upper edge of which can be seen in FIG. 5A. As a result of the cutting, the central rib 522*b* has an end which is cantilevered off of an underlying nearby purlin 518. Also resulting from the cutting is a left gap GL and a right gap GR representing short lengths of the raised ribs 522*a*, 522*c* (respectively) that have been removed to make room for the diverter 532. The gaps help provide a flow path for water removal as discussed in connection with FIG. 4.

The upper diverter 532 includes a lower flange 534, an inclined element 536, a cover structure 546, an upstanding element 538, and an upper flange 540. The lower flange 534 is substantially flat and is secured against the panel flats of the underlying roof panels. The lower flange 534 is actually in the form of two mirror image halves on opposite sides of the central raised rib 522*b*, as best seen in FIG. 5A. In that regard, the diverter 532 itself may be the combination or union of a left half member 532L and a substantial mirror image right half member 532R, which are held together by suitable tabs T and fasteners. Each half of the lower flange 534 extends through its respective gap GL, GR, providing water-conveying bottom surfaces of the diverter 532 across the gaps and to the neighboring panel flats.

The upper diverter 532 also includes an upstanding element 538 which provides an upstanding wall oriented parallel to the x-z plane and perpendicular to the lower flange 534. The upstanding element 538 terminates via a bend at its upper edge to form the upper flange 540. The upper flange 540 and the upstanding element 538 thus each extends across the entire width of the opening. And the upstanding element extends further in a segmented tapered fashion at its left and right extremities to cover or seal the exposed interiors of the severed ends of the raised ribs 522*a*, 522*c*. The upstanding element 538 may be provided in the form of two substantial mirror image halves 538L, 538R.

The upper flange 540 of the upper diverter 532 adjoins upper flanges 588L, 588R of the side rails 584L, 584R, which in turn adjoin the upper flange of the lower closure (not shown in FIGS. 5A-C) to form an uppermost rectangular frame-like flange on which a skylight or other load can rest.

Between the lower flange 534 and the upstanding element 538 are provided inclined elements 536, which also may be substantial mirror images of each other on opposite sides of the central rib 522*b*, thus forming a left inclined element 536L and a right inclined element 536R. The inclined elements are oriented to divert down-slope flowing water away from the central rib and toward their respective gaps GL, GR.

In the central area of the upper diverter 532, a cover structure 546 adjoins and connects the two halves of the lower flange 534 and the two halves of the inclined element 536. The cover structure, which may itself be considered to have a left member 546L belonging to the left diverter member 532L and a right member 546R belonging to the right diverter member 532R, is bent, welded, or otherwise formed, and specially tailored, to have distinct segmented surfaces that substantially mate or conform to the surfaces of the underlying raised rib 522*b* upon which it rests and which it covers.

Beneath the roof panels and across the width of the upper diverter 532, stiffener plates 548L, 548R are provided as shown, with angled ends or sides, to provide structural support and screw reception for screws, rivets, or other suitable fasteners used to secure the upper diverter to the roof, such as fasteners FL, FR shown in FIG. 5C. The stiffener plates 548 are of a heavier gauge (thicker) metal than that used for the roof panels. To close off all gaps and openings to water penetration, plugs made of rubber, plastic, EPDM (ethylene propylene diene monomer), or other suitable material may be used to seal off the severed ends of the ribs 522*a*, 522*c*, and furthermore, a pliable, putty-like, tape mastic, tube caulk, or the like can be used between mating parts to completely seal all gaps and prevent water leakage through or around the upper diverter 532 to the opening 526. Further teachings in this regard can be found in U.S. Pat. No. 10,352,048 (Pendley et al.).

The upper diverter 532 may be mounted on the roof such that its upstanding element 538 is nominally 8 inches from the centerline of the purlin 518 as shown in FIG. 5A, but other values for this dimension may also be used as required for the particular installation. Such values may for example be in a range from 6 to 14 inches, or from 8 to 12 inches.

Figure 6A:
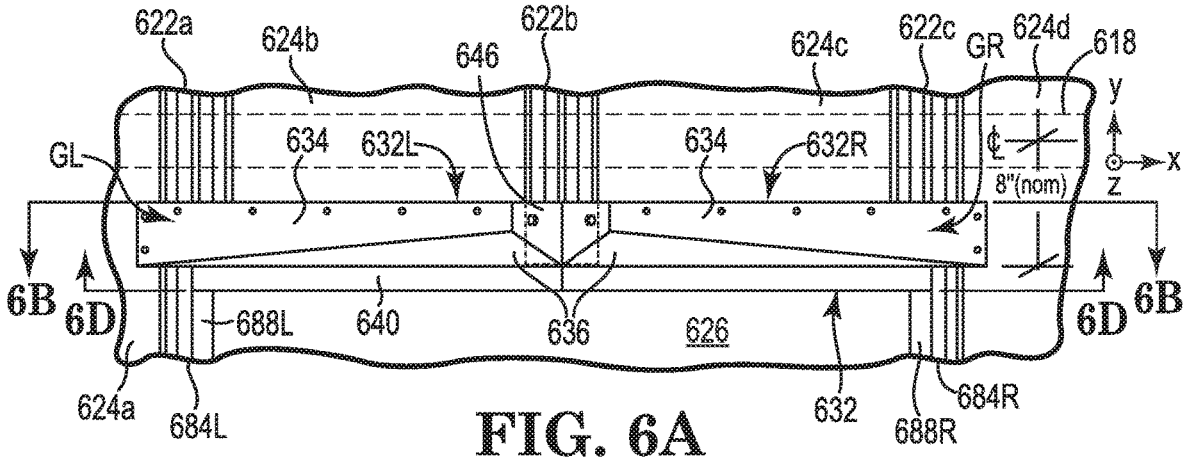
FIG. 6A is a schematic top view of a portion of a load support structure as disclosed herein, and neighboring roof elements, in the vicinity of an upper diverter.
Figure 6B:
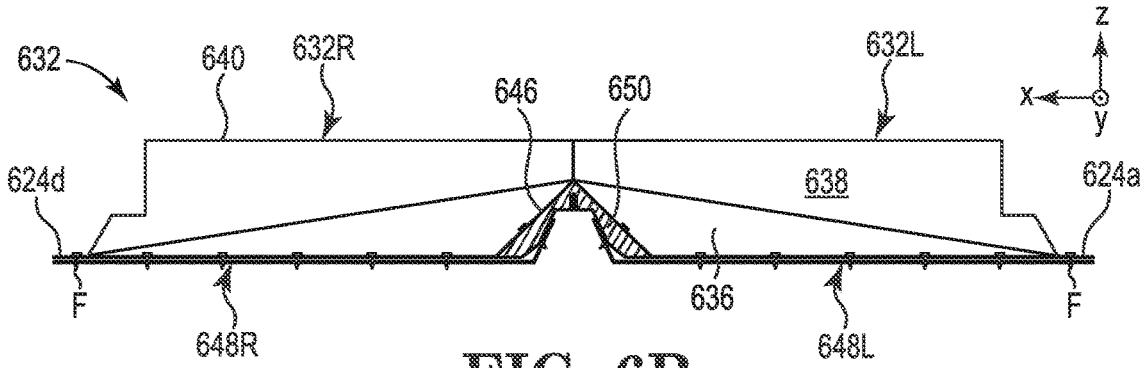
FIG. 6B is a schematic cross-sectional view along line 6B-6B in FIG. 6A.
Figure 6C:
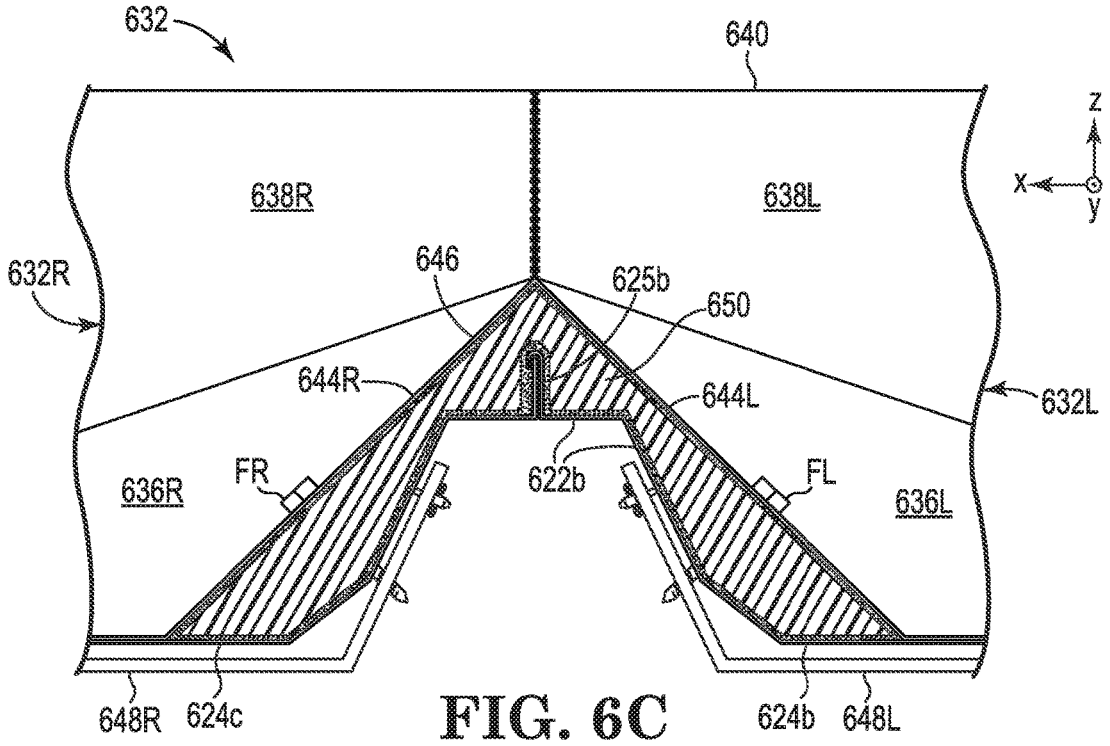
FIG. 6C is a magnified portion thereof.
Figure 6D:
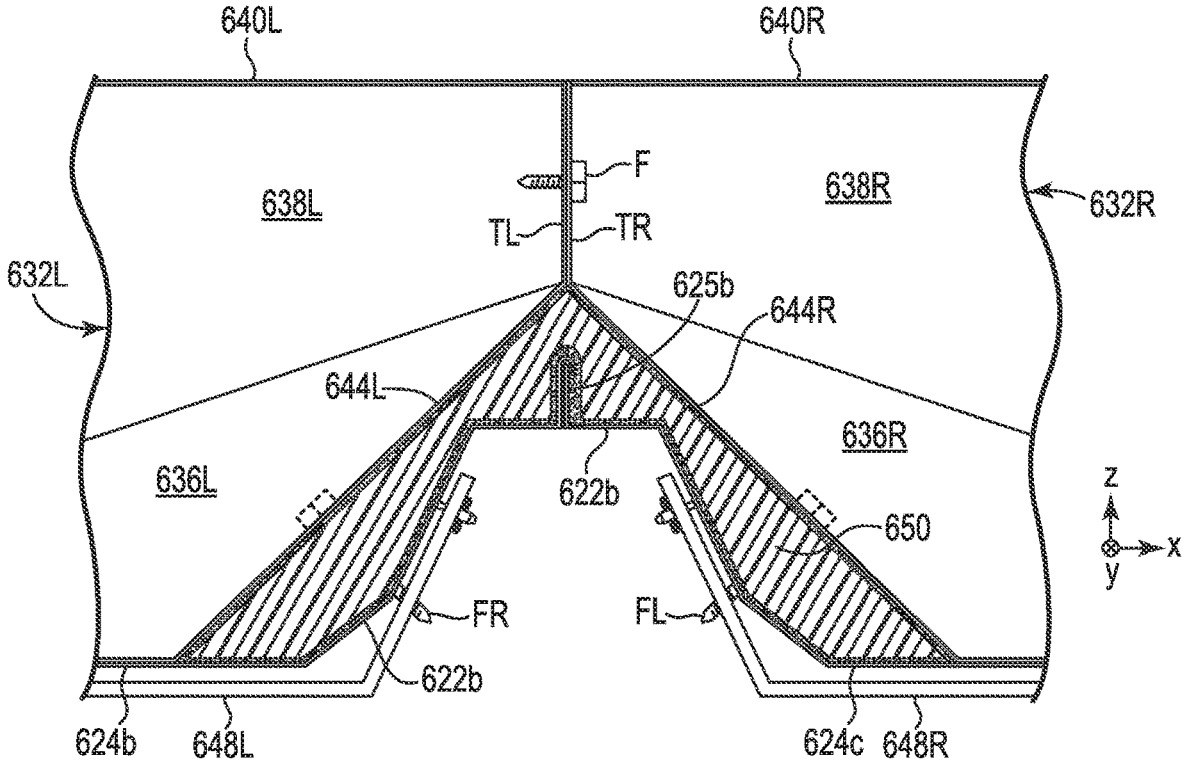
FIG. 6D is a schematic cross-sectional view along line 6D-6D in FIG. 6A.

FIGS. 6A through 6D show various schematic views of an alternative upper diverter 632 and neighboring elements of a load support structure 630 and roof, where the upper diverter 632 does advantageously make use of the adapter plugs disclosed herein for better interchangeability of component parts on different types of roofs. FIG. 6A is a top view looking in the direction of the negative z-axis, whereas FIG. 6B is a front view looking in the direction of the negative y-axis (down-slope), FIG. 6C is a magnified portion of FIG. 6B, and FIG. 6D is a magnified view of a central portion of the upper diverter along cut line 6D-6D of FIG. 6A (in the up-slope direction). Elements in these figures having the same reference number refer to the same part, component, or feature.

The load support structure 630 is mounted on a raised rib metal panel roof like that of FIGS. 2A, 4, and 5A. The metal panel roof has roof panels configured to mate with each other along their longitudinal edge portions as described above to define raised ribs, including ribs 622*a*, 622*b*, and 622*c*. Between pairs of adjacent raised ribs are panel flats 624*a*, 624*b*, 624*c*, and 624*d*. A Cartesian x-y-z coordinate system is defined as before. Portions of the roof panels and raised ribs have been cut away to define an aperture or opening 626, the upper edge of which can be seen in FIG. 6A. The central rib 622*b* has an end which is cantilevered off of an underlying nearby purlin 618. A left gap GL and a right gap GR represent short lengths of the raised ribs 622*a*, 622*c* (respectively) that have been removed to make room for the diverter 632. The gaps help provide a flow path for water removal as discussed in connection with FIG. 4.

The upper diverter 632 includes a lower flange 634, an inclined element 636, a cover structure 646, an upstanding element 638, and an upper flange 640. The lower flange 634 is substantially flat and is secured against the panel flats of the underlying roof panels. The lower flange 634 may be in the form of two mirror image halves on opposite sides of the central raised rib 622*b*, as best seen in FIG. 6A. In that regard, the diverter 632 itself may be the combination or union of a left half member 632L and a substantial mirror image right half member 632R, which are held together by suitable tabs and fasteners. Each half of the lower flange 634 extends through its respective gap GL, GR, providing water-conveying bottom surfaces of the diverter 632 across the gaps and to the neighboring panel flats.

The upper diverter 632 also includes an upstanding element 638 which provides an upstanding wall oriented parallel to the x-z plane and perpendicular to the lower flange 634. The upstanding element 638 terminates via a bend at its upper edge to form the upper flange 640. The upper flange 640 and the upstanding element 638 thus each extend across the entire width of the opening. And the upstanding element extends further in a segmented tapered fashion at its left and right extremities to cover or seal the exposed interiors of the severed ends of the raised ribs 622*a*, 622*c*. The upstanding element 638 may be provided in the form of two substantial mirror image halves 638L, 638R.

The upper flange 640 of the upper diverter 632 adjoins upper flanges 688L, 688R of the side rails 684L, 684R, which in turn adjoin the upper flange of the lower closure (not shown in FIGS. 6A-D) to form an uppermost rectangular frame-like flange on which a skylight or other load can rest.

Between the lower flange 634 and the upstanding element 638 are provided inclined elements 636, which also may be substantial mirror images of each other on opposite sides of the central rib 622*b*, thus forming a left inclined element 636L and a right inclined element 636R. The inclined elements are oriented to divert down-slope flowing water away from the central rib and toward their respective gaps GL, GR.

In the central area of the upper diverter 632, a cover structure 646 adjoins and connects the two halves of the lower flange 634 and the two halves of the inclined element 636. The cover structure 646 is much simpler in design than cover structure 546 of FIGS. 5A-C due to the presence of adapter plug 650. Thus, despite the fact that the raised rib 622*b* has the same contours and profile shape as raised rib 522*b*, the cover structure 646 may consist only of, or consist essentially of, a left cover element 644L and a right cover element 644R that are each flat and oriented to form an inverted V-shaped cover structure 646 as shown. The included angle between the cover elements 644L, 644R (the interior angle at the top of the cover structure) may be about 90 degrees, or in a range from 80 to 100 degrees, or any other suitable value. The cover structure covers and encloses an end portion of the central raised rib 622*b*, but it does not conform to the contours and shape of the rib itself. Rather, the adapter plug 650 is provided as an interface between the metal walls of the diverter 632 and the particular shape or profile of the raised rib 622*b*.

The adapter plug 650 thus has an outer surface and an inner surface, the outer surface having an outer profile, and the inner surface having an inner profile. The cover structure 646 of the upper diverter 632 substantially conforms to substantially all of, or to at least part of, the outer surface of the adapter plug, as shown best in FIGS. 6C and 6D. The inner profile of the adapter plug substantially conforms to substantially all of, or to at least part of, the rib profile, as also shown in FIGS. 6C, 6D. The adapter plug 650 is substantially smaller in size and weight than the remainder of the upper diverter 632, and it is preferably made of a material that is weather-resistant, waterproof, resilient, and extrudable or moldable. The adapter plug is also preferably at least somewhat flexible or bendable rather than brittle or inflexible to allow the installer to flex it as needed during installation when mating it up with other parts of the load support structure or roof. Suitable materials for the adapter plug include for example rubber and Ultra High Molecular Weight (UHMW) polyethylene. The rubber may be or include EPDM (ethylene propylene diene monomer) rubber, or other types of rubbers. Other materials may be or include thermoplastic elastomers (TPEs), other suitable thermoplastic materials, or suitable thermoset materials. The adapter plug 650 is made up of surfaces and edges of which some, most, or all may extend parallel to a given axis (the y-axis). As such, numerous adapter plugs 650 can be relatively easily and inexpensively made by an extrusion process and cutting the extrudate into short lengths. Alternatively, the adapter plugs can be made by a molding process or other suitable manufacturing process, or combinations of such processes. Use of the adapter plug allows the larger, heavier, more expensive (metallic) upper diverter 632 to be a standardized component that need not be specially adapted for a given raised rib profile shape, but that can be used on any type of raised rib roof by simply replacing the adapter plug 650 with another one whose inner surface is suitably tailored to conform to the different style of raised rib.

A thin layer with stippling can be seen in FIGS. 6C and 6D, as well as in other figures below, between surfaces of the adapter plug and surfaces of the cover structure, and between surfaces of the adapter plug and surfaces of the roof panels or raised rib. This stippled layer represents a thin caulk, mastic, or other suitable sealant material applied between those respective parts to provide a sealed, leak-proof construction. In describing the surfaces of the adapter plug as substantially conforming to or substantially mating with all or at least part of adjacent elements, such as the profile of the raised rib, or the surfaces of the cover structure, we include cases where the respective surfaces approximately match but do not exactly match to allow for a gap therebetween for such sealant material.

Beneath the roof panels and across the width of the upper diverter 632, stiffener plates 648L, 648R are provided as shown, with angled ends or sides, to provide structural support and screw reception for screws, rivets, or other suitable fasteners. Rivets for example can be used to secure inclined walls of the raised rib 622*b* to the underlying stiffener plates 648L, 648R, and screwbolts (see fasteners FL, FR), which may be self-tapping and/or self-drilling, can be used to secure the upper diverter 632 to the same stiffener plates through the roof panels and the adapter plug 650, as shown in FIGS. 6C, 6D. The stiffener plates 648 are of a heavier gauge (thicker) metal than that used for the roof panels. To close off all gaps and openings to water penetration, plugs made of rubber, plastic, EPDM, or other suitable material may be used to seal off the severed ends of the ribs 622*a*, 622*c*, and furthermore, a pliable, putty-like, tape mastic, tube caulk, tube sealant, or other suitable sealant can be used between mating parts to completely seal all gaps and prevent water leakage through or around the upper diverter 632 to the opening 626, as well as to facilitate installation of the load support structure.

FIG. 6D provides a view of the back side of the diverter 632, showing how it can comprise a union of a left and right diverter member 632L, 632R held together by tabs such as tabs TL, TR fastened together with one or more screws, bolts, rivets, or other suitable fasteners F. This figure also shows how the upstanding elements 638L, 638R may be bent along their upper edges to provide upper flanges 640L, 640R (together forming flange 640). FIGS. 6C and 6D also demonstrate how screws, rivets, or other suitable fasteners FR, FL can pass through the cover structure 646, roofing panels, adapter plug 650, and stiffener plates 648 to secure the upper diverter 632 in place on the roof.

The upper diverter 632 may be mounted on the roof such that its upstanding element 638 is nominally 8 inches from the centerline of the purlin 618 as shown in FIG. 6A, but other values for this dimension may also be used as required for the particular installation. Such values may for example be in a range from 6 to 14 inches, or from 8 to 12 inches.

Figure 7A:
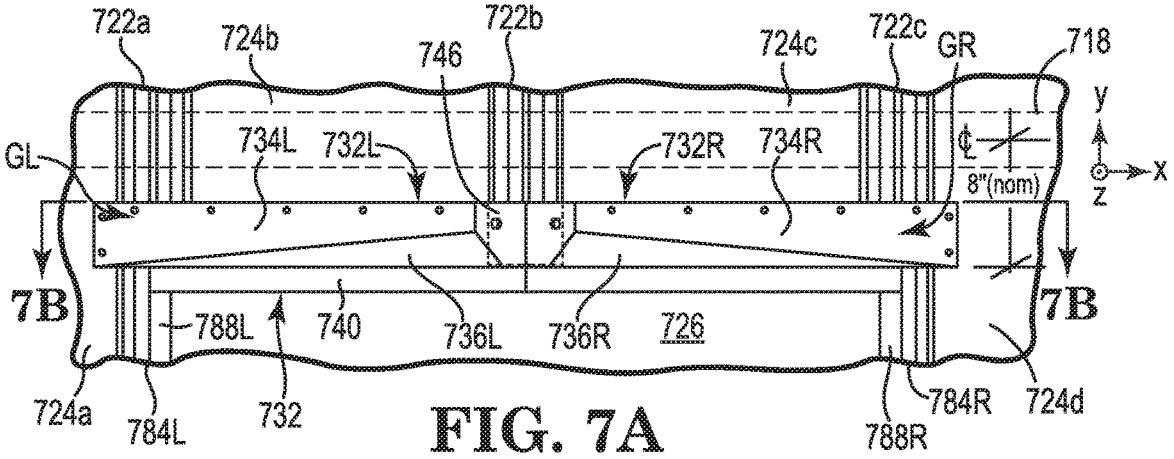
FIG. 7A is a schematic top view of a portion of an alternative load support structure as disclosed herein, and neighboring roof elements, in the vicinity of an upper diverter.
Figure 7B:
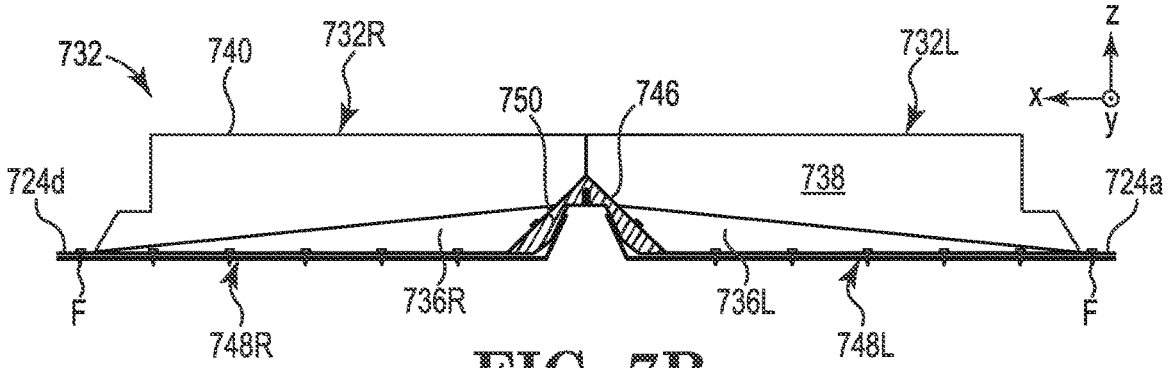
FIG. 7B is a schematic cross-sectional view along line 7B-7B in FIG. 7A.
Figure 7C:
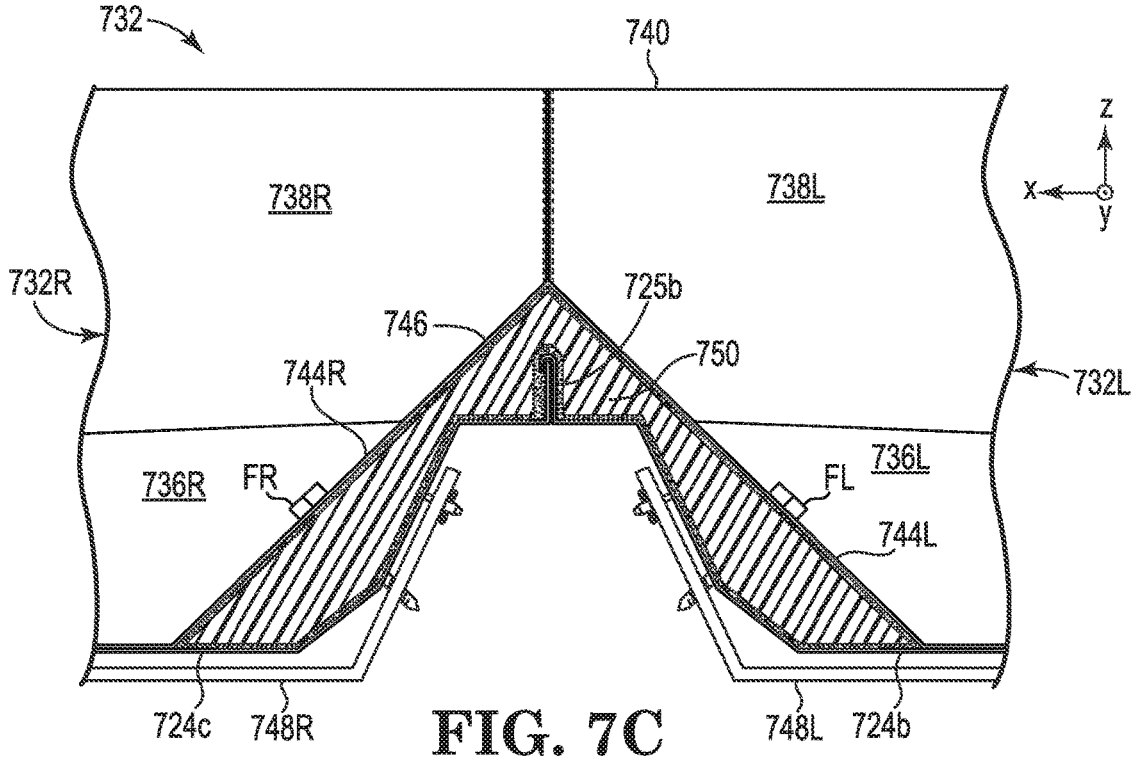
FIG. 7C is a magnified portion thereof.

FIGS. 7A through 7D show various schematic views of another upper diverter 732 and neighboring elements of a load support structure 730 and roof, where, like diverter 632 described above, the upper diverter 732 does make use of the adapter plugs disclosed herein. FIG. 7A is a top view looking in the direction of the negative z-axis, whereas FIG. 7B is a front view looking in the direction of the negative y-axis (down-slope), and FIG. 7C is a magnified portion of FIG. 7B. Elements in these figures having the same reference number refer to the same part, component, or feature.

The load support structure 730 is mounted on a raised rib metal panel roof like that of FIGS. 2A, 4, 5A, and 6A. The metal panel roof has roof panels configured to mate with each other along their edge portions to define raised ribs, including ribs 722*a*, 722*b*, and 722*c*. Between pairs of adjacent raised ribs are panel flats 724*a*, 724*b*, 724*c*, and 724*d*. A Cartesian x-y-z coordinate system is defined as before. An aperture or opening 726 is formed in the roof as previously described. The central rib 722*b* has an end which is cantilevered off of an underlying nearby purlin 718. A left gap GL and a right gap GR represent short lengths of the raised ribs 722*a*, 722*c* (respectively) that have been removed to make room for the diverter 732. The gaps help provide a flow path for water passage/drainage as discussed in connection with FIG. 4.

The upper diverter 732 includes a lower flange 734, an inclined element 736, a cover structure 746, an upstanding element 738, and an upper flange 740. The lower flange 734 is substantially flat and is secured against the panel flats of the underlying roof panels. The lower flange 734 may be in the form of two mirror image halves on opposite sides of the central raised rib 722*b*, as best seen in FIG. 7A. The diverter 732 itself may be the combination or union of a left half member 732L and a substantial mirror image right half member 732R, which are held together by suitable tabs and fasteners. Each half of the lower flange 734 extends through its respective gap GL, GR, providing water-conveying bottom surfaces of the diverter 732 across the gaps and to the neighboring panel flats.

The upper diverter 732 also includes an upstanding element 738 which provides an upstanding wall oriented parallel to the x-z plane and perpendicular to the lower flange 734. The upstanding element 738 terminates via a bend at its upper edge to form the upper flange 740. The upper flange 740 and the upstanding element 738 thus each extends across the entire width of the opening. The upstanding element extends further in a segmented tapered fashion at its left and right extremities to cover or seal the exposed interiors of the severed ends of the raised ribs 722*a*, 722*c*. The upstanding element 738 may be provided in the form of two substantial mirror image halves 738L, 738R.

The upper flange 740 of the upper diverter 732 adjoins upper flanges 788L, 788R of the side rails 784L, 784R, which in turn adjoin the upper flange of the lower closure (not shown in FIGS. 7A-C) to form an uppermost rectangular frame-like flange on which a skylight or other load can rest.

Between the lower flange 734 and the upstanding element 738 are provided inclined elements 736, which also may be substantial mirror images of each other on opposite sides of the central rib 722*b*, thus forming a left inclined element 736L and a right inclined element 736R. The inclined elements are oriented to divert down-slope flowing water away from the central rib and toward their respective gaps GL, GR. The inclined elements 736L, 736R differ from their counterparts in FIGS. 6A-D insofar as the inclined elements 736L, 736R rise to only a fraction of the full height of the cover structure 746, whereas the inclined elements 636L, 636R rise to the full height of the cover structure 646, and intersect the apex of the cover structure 646.

In the central area of the upper diverter 732, the cover structure 746 adjoins and connects the two halves of the lower flange 734 and the two halves of the inclined element 736. The cover structure 746 is simple in design like that of cover structure 646 due to the presence of adapter plug 750. Thus, the cover structure 746 may consist only of, or consist essentially of, a left cover element 744L and a right cover element 744R that are each flat and oriented to form an inverted V-shaped cover structure 746 as shown. The included angle between the cover elements 744L, 744R (the interior angle at the top of the cover structure) may be about 90 degrees, or in a range from 80 to 100 degrees, or any other suitable value. The cover structure covers and encloses an end portion of the central raised rib 722*b*, but it does not conform to the contours and shape of the rib itself. Rather, the adapter plug 750 is provided as an interface between the metal walls of the diverter 732 and the particular shape or profile of the raised rib 722*b*.

The adapter plug 750 may be the same as or similar to the adapter plug 650 described above, with some or all of the described features of plug 650 applying equally to plug 750.

Beneath the roof panels and across the width of the upper diverter 732, stiffener plates 748L, 748R may be provided as shown, with angled ends or sides, to provide structural support and screw reception for screws, rivets, or other suitable fasteners. Rivets for example can be used to secure inclined walls of the raised rib 722*b* to the underlying stiffener plates 748L, 748R, and screws or screwbolts (see fasteners FL, FR), which may be self-tapping and/or self-drilling, can be used to secure the upper diverter 732 to the same stiffener plates through the roof panels and the adapter plug 750, as shown in FIG. 7C. The stiffener plates 748 are of a heavier gauge (thicker) metal than that used for the roof panels. Plugs made of rubber, plastic, EPDM, or other suitable material may be used to seal off the severed ends of the ribs 722*a*, 722*c*, and a pliable, putty-like, tape mastic, tube caulk, or the like can be used between mating parts to completely seal all gaps and prevent water leakage through or around the upper diverter 732 to the opening 726. The diverter 732 may comprise a union of a left and right diverter member 732L, 732R held together by tabs such as tabs TL, TR fastened together with one or more screws, rivets, or other suitable fasteners F. The upstanding elements 738L, 738R may be bent along their upper edges to provide upper flanges which together form the flange 740. Screws, rivets, or other suitable fasteners FR, FL can pass through the cover structure 746, roofing panels, adapter plug 750, and stiffener plates 748 to secure the upper diverter 732 in place on the roof.

The upper diverter 732 may be mounted on the roof such that its upstanding element 738 is nominally 8 inches from the centerline of the purlin 718 as shown in FIG. 7A, but other values for this dimension may also be used as required for the particular installation. Such values may for example be in a range from 6 to 14 inches, or from 8 to 12 inches.

In order to mount the upper diverter of FIGS. 6A-6D, or the upper diverter of FIGS. 7A-7C, onto a roof with a differently shaped raised rib (see e.g. FIGS. 3A-3E above), all that is needed is to replace the adapter plug 650 (or the adapter plug 750) with an adapter plug that has the same outer surface and outer profile configuration but a different inner surface and inner profile configuration. Some such alternative adapter plugs are shown schematically in FIGS. 8A-8E. Their corresponding associated raised rib profiles are shown in FIGS. 9A-9E respectively.

Figure 8A:
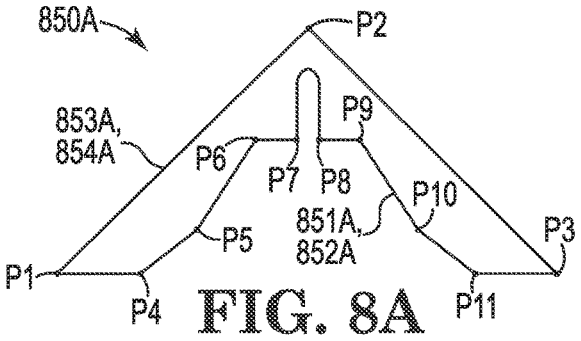
FIGS. 8A-8E are schematic front or cross-sectional views of alternative adapter plugs for use in the disclosed load support structures.
Figure 9A:
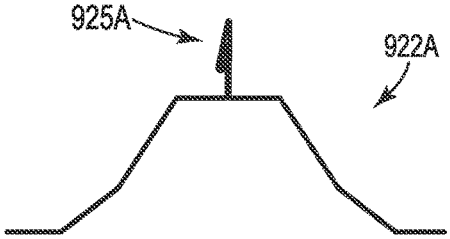
FIGS. 9A-9E are schematic front or cross-sectional views of different rib profiles corresponding respectively to FIGS. 8A-8E.

In FIG. 8A, an adapter plug 850A is shown that is adapted to mate with or substantially conform to the raised rib profile of FIG. 9A. The raised rib 922A of that figure also includes a standing seam 925A. In fact, the raised rib 922A may be the same as raised ribs 622 (a,b,c) and 722 (a,b,c) described above, and the adapter plug 850A may be the same as adapter plugs 650, 750 described above. The adapter plug 850A is generally concave in shape and as such has an outer surface 853A defining an outer profile 854A, the profile 854A extending from point P1 to P2 to P3 as shown in the figure. The generally concave adapter plug 850A also has an inner surface 851A defining an inner profile 852A, the profile 852A extending from point P4 to P5 to P6 to P7, then rising upward into a narrow cavity but curving sharply back down to P8, then to P9, P10, and P11. When the adapter plug is viewed in three dimensions, the points P1 through P11 correspond to edges of the respective surfaces, which edges all extend perpendicular to the plane of FIG. 8A and are thus all parallel to each other.

The cover structure of the upper diverter (and/or the cover structure of the lower closure, as discussed below) is preferably configured to mate with, conform to, or substantially conform to, all or at least part of the outer surface 853A. Similarly, the inner profile 852A and/or the inner surface 851A is configured to mate with, conform to, or substantially conform to all or at least part of the profile of the raised rib 922A, including the standing seam 925A. In this regard, by "substantially conform" or "substantially mate" we mean that the given profiles or surfaces may approximately but not exactly match due to manufacturing tolerances and/or installation tolerances, and/or due to small gaps or spaces between parts that may for example be deliberately designed to install or apply (admit) caulk, tape mastic, or other suitable sealant materials.

Figure 8B:
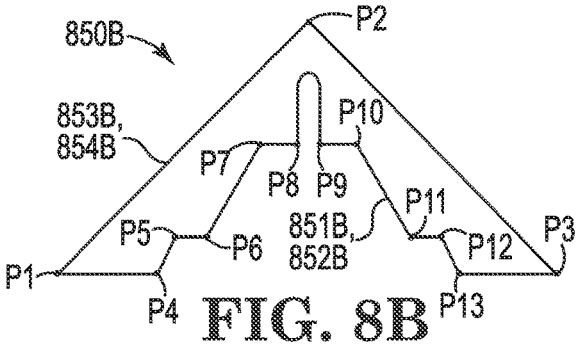
Figure 9B:
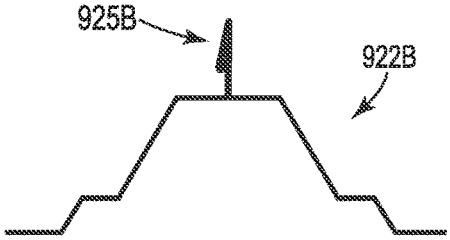

In FIG. 8B, an adapter plug 850B is shown that is adapted to mate with or substantially conform to the raised rib profile of FIG. 9B. The raised rib 922B of that figure also includes a standing seam 925B. The adapter plug 850B is generally concave in shape and as such has an outer surface 853B defining an outer profile 854B, the profile 854B extending from point P1 to P2 to P3 as shown in the figure. The generally concave adapter plug 850B also has an inner surface 851B defining an inner profile 852B, the profile 852B extending from point P4 to P5 to P6 to P7 to P8, then rising upward into a narrow cavity but curving sharply back down to P9, then to P10, P11, P12, and P13. When the adapter plug is viewed in three dimensions, the points P1 through P13 correspond to edges of the respective surfaces, which edges all extend perpendicular to the plane of FIG. 8B and are thus all parallel to each other.

The cover structure of the upper diverter (and/or the cover structure of the lower closure, as discussed below) is preferably configured to mate with, conform to, or substantially conform to, all or at least part of the outer surface 853B. Similarly, the inner profile 852B and/or the inner surface 851B is configured to mate with, conform to, or substantially conform to all or at least part of the profile of the raised rib 922B, including the standing seam 925B.

Figure 8C:
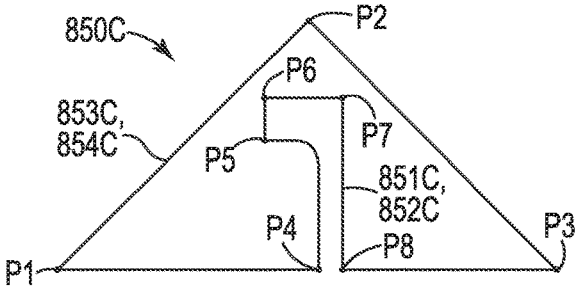
Figure 9C:
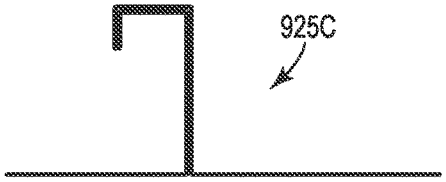

In FIG. 8C, an adapter plug 850C is shown that is adapted to mate with or substantially conform to the raised rib profile of FIG. 9C. The raised rib of FIG. 9C is substantially a standing seam 925C. The adapter plug 850C is generally concave in shape and as such has an outer surface 853C defining an outer profile 854C, the profile 854C extending from point P1 to P2 to P3 as shown in the figure. The generally concave adapter plug 850C also has an inner surface 851C defining an inner profile 852C, the profile 852C extending from point P4 to P5 to P6 to P7 to P8. When the adapter plug is viewed in three dimensions, the points P through P8 correspond to edges of the respective surfaces, which edges all extend perpendicular to the plane of FIG. 8C and are thus all parallel to each other.

The cover structure of the upper diverter (and/or the cover structure of the lower closure, as discussed below) is preferably configured to mate with, conform to, or substantially conform to, all or at least part of the outer surface 853C. Similarly, the inner profile 852C and/or the inner surface 851C is configured to mate with, conform to, or substantially conform to all or at least part of the profile of the raised rib (standing seam) 925C.

Figure 8D:
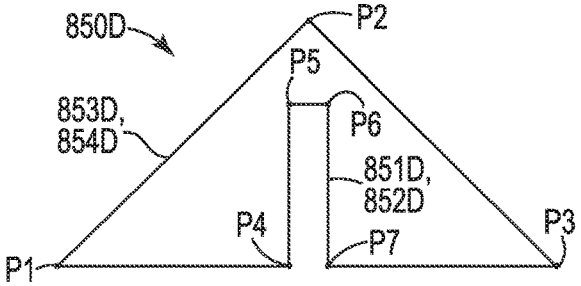
Figure 9D:
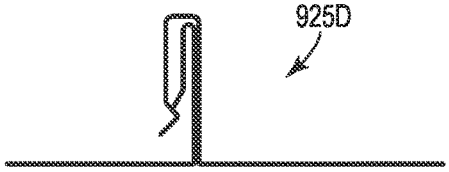

In FIG. 8D, an adapter plug 850D is shown that is adapted to mate with or substantially conform to the raised rib profile of FIG. 9D. The raised rib of FIG. 9D is substantially a standing seam 925D. The adapter plug 850D is generally concave in shape and as such has an outer surface 853D defining an outer profile 854D, the profile 854D extending from point P1 to P2 to P3 as shown in the figure. The generally concave adapter plug 850D also has an inner surface 851D defining an inner profile 852D, the profile 852D extending from point P4 to P5 to P6 to P7. When the adapter plug is viewed in three dimensions, the points P1 through P7 correspond to edges of the respective surfaces, which edges all extend perpendicular to the plane of FIG. 8D and are thus all parallel to each other.

The cover structure of the upper diverter (and/or the cover structure of the lower closure, as discussed below) is preferably configured to mate with, conform to, or substantially conform to, all or at least part of the outer surface 853D. Similarly, the inner profile 852D and/or the inner surface 851D is configured to mate with, conform to, or substantially conform to all or at least part of the profile of the raised rib (standing seam) 925D.

Figure 8E:
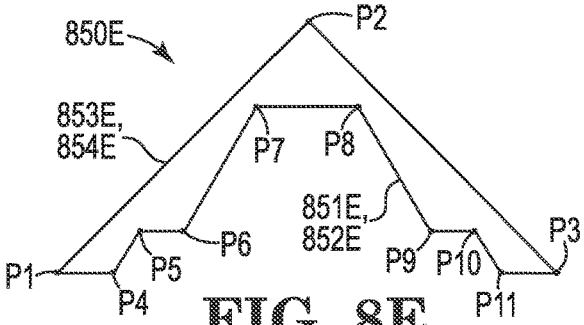
Figure 9E:
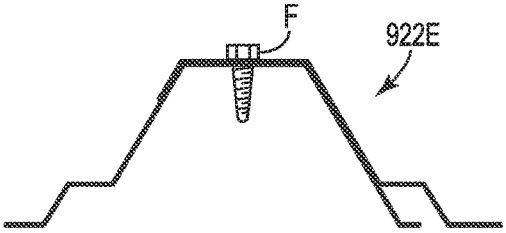

In FIG. 8E, an adapter plug 850E is shown that is adapted to mate with or substantially conform to the raised rib profile ("R" panel) of FIG. 9E. The adapter plug 850E is generally concave in shape and as such has an outer surface 853E defining an outer profile 854E, the profile 854E extending from point P1 to P2 to P3 as shown in the figure. The generally concave adapter plug 850E also has an inner surface 851E defining an inner profile 852E, the profile 852E extending from point P4 to P5 to P6 to P7 to P8 to P9 to P10 to P11. When the adapter plug is viewed in three dimensions, the points P1 through P11 correspond to edges of the respective surfaces, which edges all extend perpendicular to the plane of FIG. 8E and are thus all parallel to each other.

The cover structure of the upper diverter (and/or the cover structure of the lower closure, as discussed below) is preferably configured to mate with, conform to, or substantially conform to, all or at least part of the outer surface 853E. Similarly, the inner profile 852E and/or the inner surface 851E is configured to mate with, conform to, or substantially conform to all or at least part of the profile of the raised rib 922E.

Note that in some but not all cases, the adapter plug possesses mirror symmetry relative to a vertical plane passing through the apex of the adapter plug. Such symmetry simplifies installation by allowing the plug to be installed in either direction.

Figure 10:
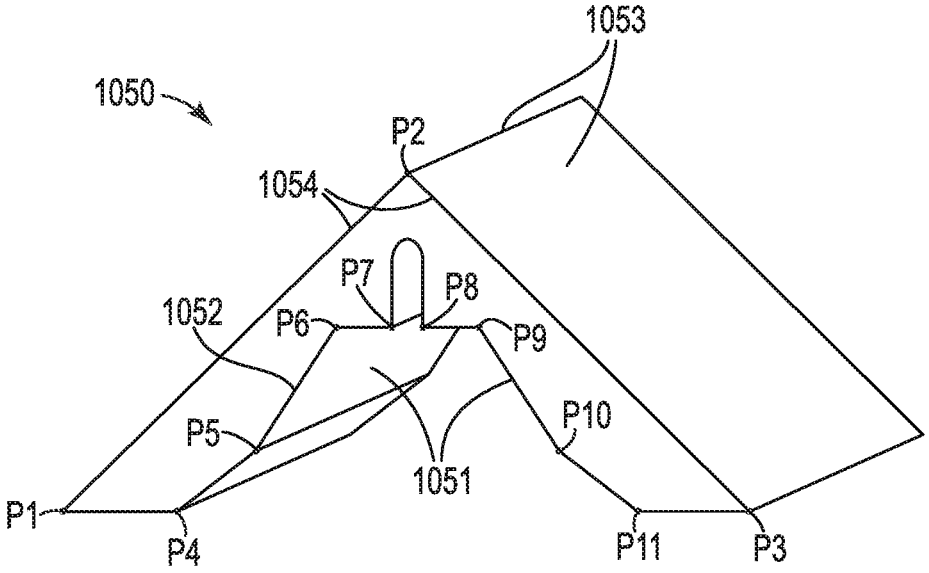
FIG. 10 is a schematic perspective view of an adapter plug.

A three-dimensional perspective view of a representative adapter plug 1050 is shown in FIG. 10. The adapter plug 1050 may in fact be the same as adapter plugs 650, 750, and 850A described above. In that regard, the inner surface 1051 may be the same as inner surface 851A, and the inner profile 1052 may be the same as inner profile 852A. Likewise, the outer surface 1053 may be the same as outer surface 853A, and the outer profile 1054 may be the same as outer profile 854A. The points P1 through P11 in FIG. 10 may be the same as corresponding points P1 through P11 in FIG. 8A. In FIG. 10 it is easy to see how the points P1 through P11 correspond to edges of the respective inner and outer surfaces, and easy to see that the edges are all parallel to each other. In typical embodiments, the length of a given adapter plug (i.e., the distance measured along any one of its parallel edges) may be at least 0.5 inches, or in a range from 0.5 to 3 inches, or from 1 to 2 inches, but other lengths can be used as required for the intended application.

Figure 11:
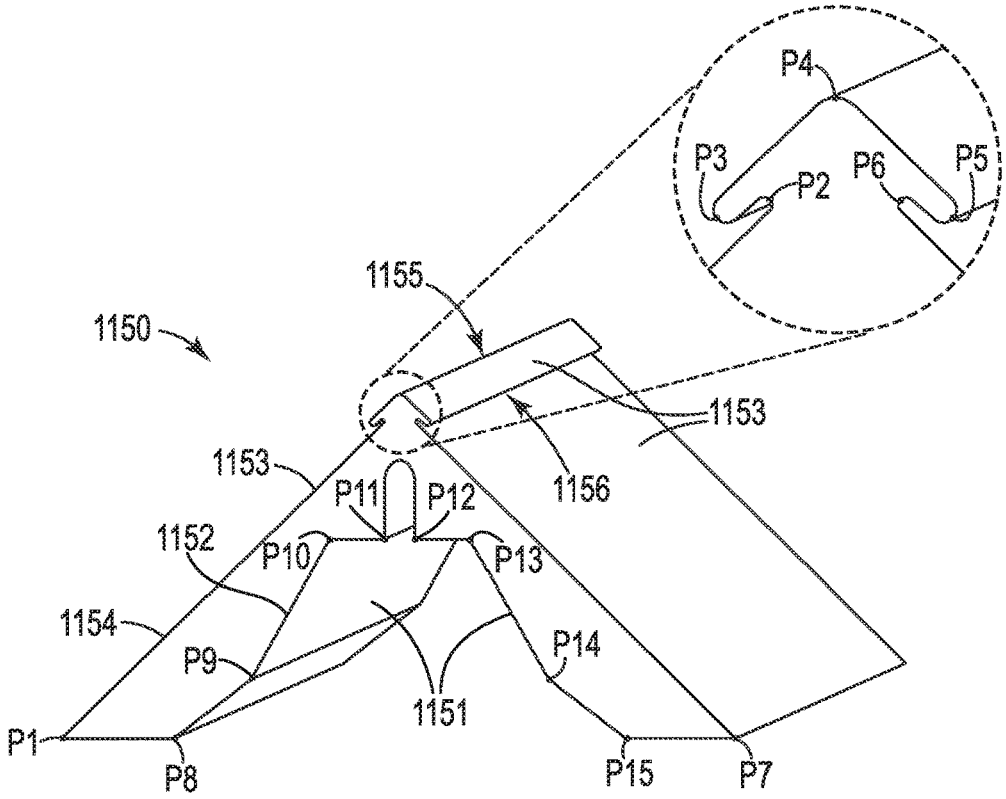
FIG. 11 is a schematic perspective view of an alternative adapter plug with a self-sealing feature on top.

An alternative adapter plug design that contains a self-sealing cap portion is shown in FIG. 11. There, an adapter plug 1150 is shown that is similar to the adapter plug 1050, except that the plug 1150 includes a cap portion 1155. The cap portion 1155 flares out to define a longitudinal groove 1156 on both sides of the cap portion.

The adapter plug 1150 is generally concave in shape and as such has an outer surface 1153 defining an outer profile 1154, the profile 1154 extending from point P1 to P2 to P3 to P4 to P5 to P6 to P7 as shown in the figure. The generally concave adapter plug 1150 also has an inner surface 1151 defining an inner profile 1152, the profile 1152 extending from point P8 to P9 to P10 to P11, then rising upward into a narrow cavity but curving sharply back down to P12, then to P13, P14, and P15. The points P1 through P15 correspond to edges of the respective surfaces, which edges all extend parallel to each other.

Figure 12:
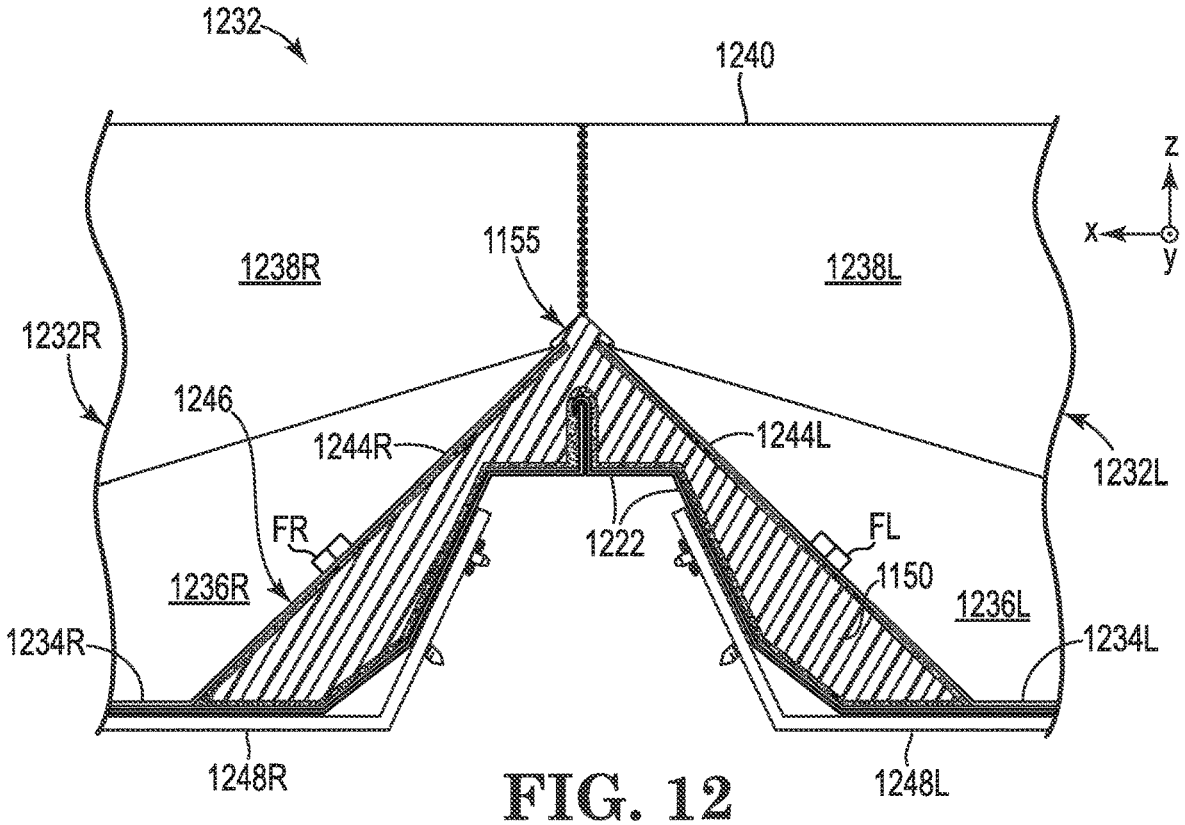
FIG. 12 is a schematic cross-sectional view of a portion of a load support structure similar to that of FIG. 6C, but modified by including a self-sealing feature at the top of the adapter plug.

The adapter plug 1150 can be used with a load support structure similar to that shown in FIGS. 6 and 7 by modifying the cover structure of the upper diverter to accommodate the cap portion 1155 and related features of the adapter plug. A schematic view of such an arrangement, analogous to the view of FIG. 6C, is shown in FIG. 12. This view looks along the negative y-axis (down-slope) at an upper diverter 1232 at a position corresponding to line 6B-6B in FIG. 6A.

The upper diverter 1232 can comprise a union of a left and right diverter member 1232L, 1232R held together by tabs fastened with one or more screws, rivets, or other suitable fasteners. The diverter 1232 includes an upstanding element 1238 (optionally provided in the form of two substantial mirror image halves 1238L, 1238R) which provides an upstanding wall oriented parallel to the x-z plane and perpendicular to the lower flange 1234 (provided in the form of a left half 1234L and a right half 1234R). The upstanding element 1238 terminates via a bend at its upper edge to form an upper flange 1240. The upper flange 1240 and the upstanding element 1238 each extends across the entire width of the opening, and the upstanding element may extend further in a segmented tapered fashion at its left and right extremities in similar fashion to that shown in FIG. 6B.

Between the lower flange 1234 and the upstanding element 1238 are provided inclined elements 1236, which also may be substantial mirror images of each other on opposite sides of the central rib 1222, thus forming a left inclined element 1236L and a right inclined element 1236R. The inclined elements are oriented to divert down-slope flowing water away from the central rib and toward the respective gaps in the adjacent raised ribs as shown for example in FIG. 6A.

In the central area of the upper diverter 1232, a cover structure 1246 consists only of, or consists essentially of, a left cover element 1244L and a right cover element 1244R that are each flat and oriented to form an inverted V-shaped cover structure 1246 as shown, but now with a space or gap between the elements 1244L, 1244R, at the vertex of the inverted V. The included angle between the cover elements 1244L, 1244R may be about 90 degrees, or in a range from 80 to 100 degrees, or any other suitable value. As shown in FIG. 12, the cap portion 1155 extends through this gap, and upper edges of the left and right cover elements 1244L, 1244R mate with the respective slots 1156 defined by the cap portion 1155 of the adapter plug 1150. In this way, the upper portion (cap portion 1155) of the adapter plug 1150 can provide a watertight seal between the cover elements 1244L, 1244R without having to weld or otherwise seal the edges of the cover elements 1244L, 1244R to each other.

Beneath the roof panels and across the width of the upper diverter 1232, stiffener plates 1248L, 1248R may be provided beneath the roof panels in like fashion to FIGS. 6C, 6D, with angled ends or sides, to provide structural support and screw reception for screws, rivets, or other suitable fasteners used to secure the upper diverter to the roof, such as screwbolt fasteners FL, FR.

The disclosed adapter plugs can be used not only on the upper diverter portion of the load support structure, but also, or alternatively, on the lower closure portion of the load support structure, so that the lower closure can also be used universally or interchangeably on raised rib metal panel roofs of any rib profile.

Figure 13A:
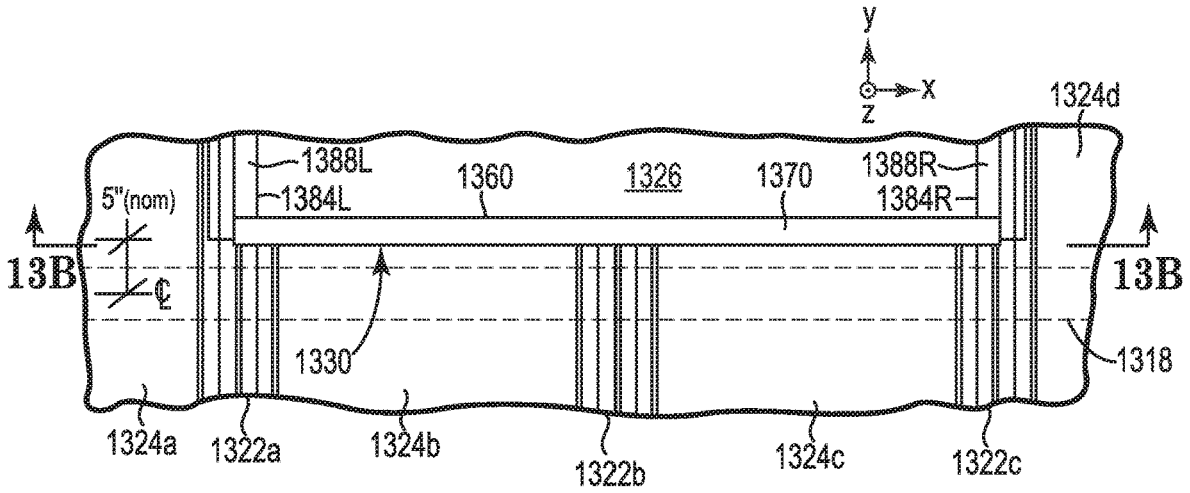
FIG. 13A is a schematic top view of a portion of a load support structure, and neighboring roof elements, in the vicinity of a lower closure, the lower closure being of a conventional design.
Figure 13B:
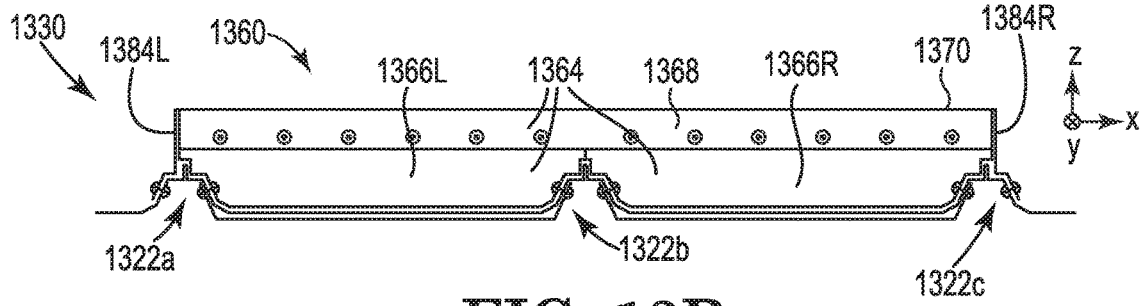
FIG. 13B is a schematic cross-sectional view along line 13B-13B in FIG. 13A.
Figure 13C:
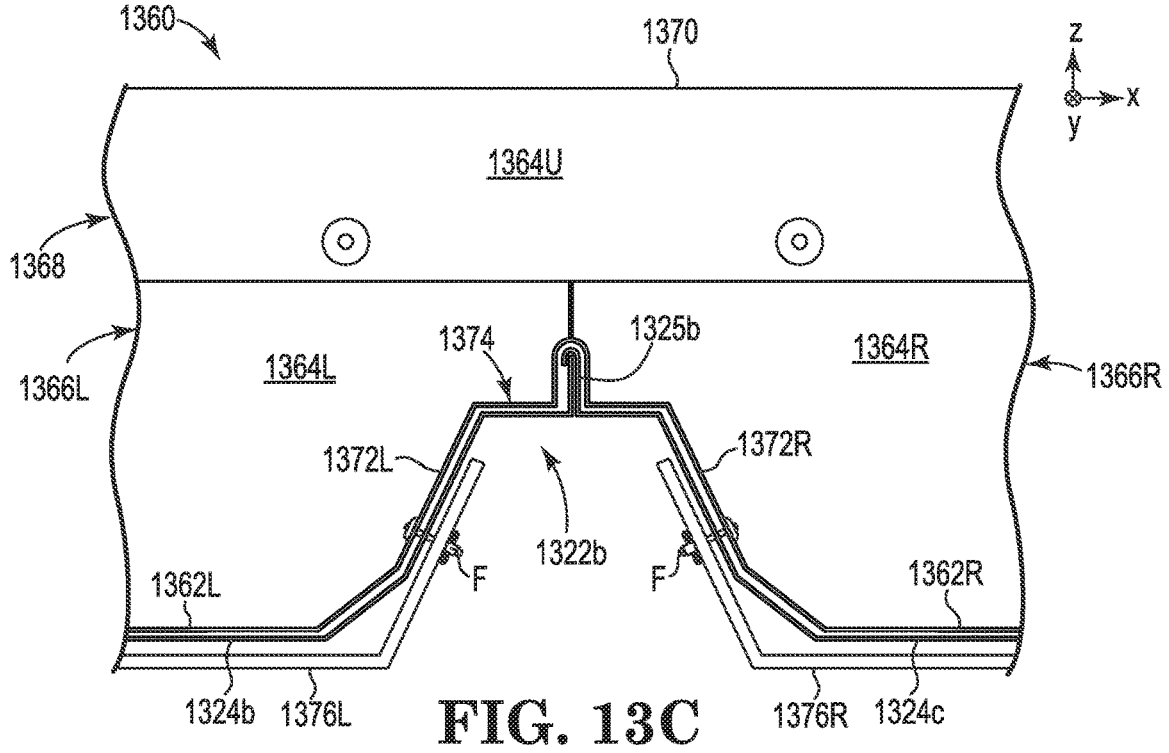
FIG. 13C is a magnified portion thereof.

FIGS. 13A through 13C show various schematic views of a lower closure 1360 and neighboring elements of a load support structure 1330 and roof, where, for comparison purposes, the lower closure 1360 does not make use of the adapter plugs disclosed herein. FIG. 13A is a top view looking in the direction of the negative z-axis, whereas FIG. 13B is a front view looking in the direction of the positive y-axis (up-slope), and FIG. 13C is a magnified portion of FIG. 13B. Elements in these figures that have the same reference number refer to the same part, component, or feature.

The load support structure 1330 is mounted on a raised rib metal panel roof like that of others described above. The metal panel roof has roof panels configured to mate with each other along their edge portions to define raised ribs, including ribs 1322*a*, 1322*b*, and 1322*c*. Between pairs of adjacent raised ribs are panel flats 1324*a*, 1324*b*, 1324*c*, and 1324*d*. A Cartesian x-y-z coordinate system is defined as before, with the x-y plane being parallel to the plane of the roof and the y-axis pointed in the up-slope direction. Portions of the roof panels and raised ribs have been cut away to define an aperture or opening 1326, the lower edge of which can be seen in FIG. 13A. As a result of the cutting, the central rib 1322*b* has an end which is cantilevered off of an underlying nearby purlin 1318.

The lower closure 1360 includes a lower flange 1362 (with left and right halves 1362L, 1362R), a cover structure 1374, an upstanding element 1364 (with lower left, lower right, and upper portions 1364L, 1364R, 1364U), and an upper flange 1370. The lower flange 1362 is substantially flat and is secured against the panel flats of the underlying roof panels. The lower flange 1362 is actually in the form of two mirror image halves on opposite sides of the central raised rib 1322*b*. In that regard, the lower closure 1360 may be the combination or union of three separate members—an upper portion 1368, a lower left portion 1366L, and a lower right portion 1366R which may be a substantial mirror image of portion 1366L-which are held together by tabs and fasteners or by other suitable means. Splitting the lower closure 1360 into these separate members can make the installation procedure easier.

The lower closure 1360 also includes an upstanding element 1364 which provides an upstanding wall oriented parallel to the x-z plane and perpendicular to the lower flange 1362, and which may comprise a lower left portion 1364L, a lower right portion 1364R which may be a substantial mirror image of the portion 1364L, and an upper portion 1364U. The upstanding element 1364 terminates via a bend at its upper edge to form the upper flange 1370. The upper flange 1370 and the upstanding element 1364 thus each extends across the entire width of the opening.

The upper flange 1370 of the lower closure 1360 adjoins upper flanges 1388L, 1388R of the side rails 1384L, 1384R, which in turn adjoin the upper flange of the upper diverter (not shown in FIGS. 13A-C) to form an uppermost rectangular frame-like flange on which a skylight or other load can rest.

In the central area of the lower closure 1360, a cover structure 1374 adjoins and connects the two halves of the lower flange 1362 and the two upstanding element portions 1364L, 1364R. The cover structure, which may itself be considered to have a left cover element 1372L belonging to the lower left portion 1366L and a right cover element 1372R belonging to the lower right portion 1366R, is bent, welded, or otherwise shaped, and specially tailored, to have distinct segmented surfaces that substantially mate or conform to the surfaces of the underlying raised rib 1322*b* upon which it rests and which it covers. Such accommodations to the specific shape of the raised rib must also be made at the left extremity of the lower closure 1360 (for raised rib 1322*a*) and at the right extremity of the lower closure (for raised rib 1322*c*).

Beneath the roof panels and across the width of the lower closure 1360, stiffener plates 1376L, 1376R may be provided as shown, with angled ends or sides, to provide structural support and screw reception for screws, rivets, or other suitable fasteners used to secure the lower closure to the roof, such as fasteners F shown in FIG. 13C. The stiffener plates 1376 are of a heavier gauge (thicker) metal than that used for the roof panels. To close off all gaps and openings to water penetration, plugs made of rubber, plastic, EPDM (ethylene propylene diene monomer), or other suitable material may be used to seal off the severed ends of the ribs 1322*a, b, c*, and furthermore, a pliable, putty-like, tape mastic, tube caulk, or the like can be used between mating parts to completely seal all gaps and prevent water leakage through or around the lower closure 1360 to the opening 1326.

The lower closure 1330 may be mounted on the roof such that its upstanding element 1364 is nominally 5 inches from the centerline of the purlin 1318 as shown in FIG. 13A, but other values for this dimension may also be used as required for the particular installation.

Figure 14A:
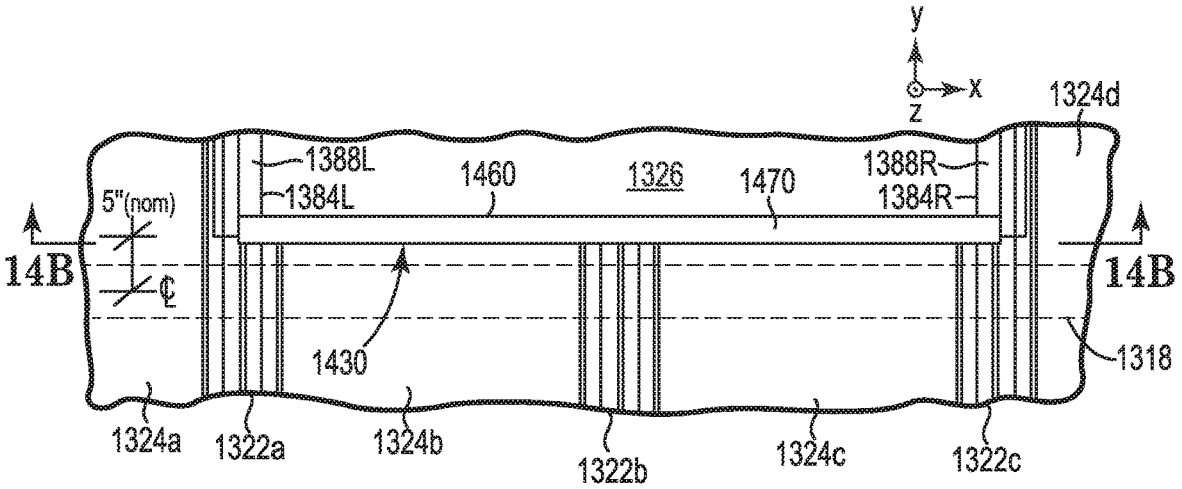
FIG. 14A is a schematic top view of a portion of a load support structure as disclosed herein, and neighboring roof elements, in the vicinity of a lower closure.
Figure 14B:
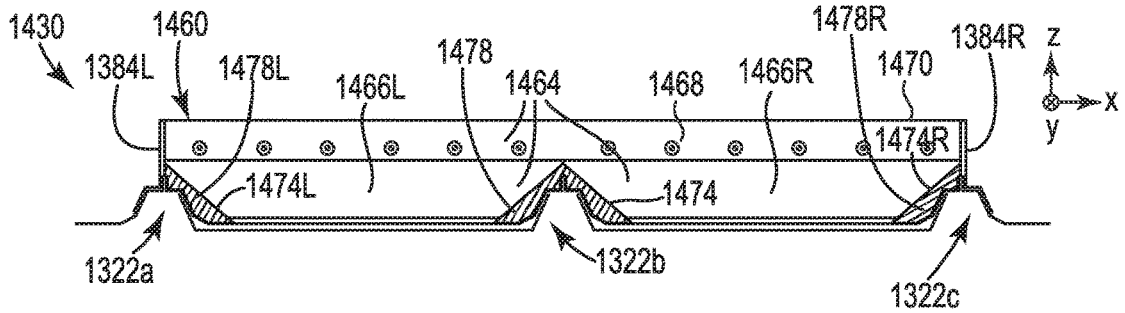
FIG. 14B is a schematic cross-sectional view along line 14B-14B in FIG. 14A.
Figure 14C:
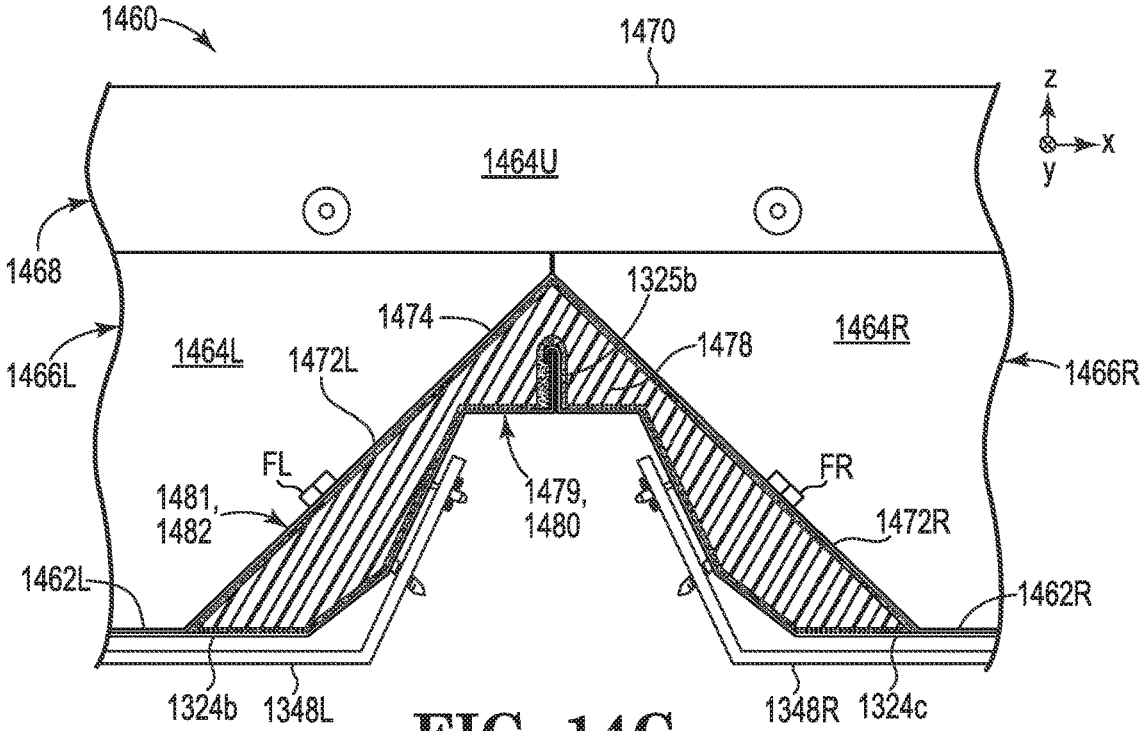
FIG. 14C is a magnified portion thereof.

FIGS. 14A through 14C show various schematic views of an alternative lower closure 1460 and neighboring elements of a load support structure 1430 and roof, where the lower closure 1460 does advantageously make use of the adapter plugs disclosed herein for better interchangeability of component parts on different types of roofs. FIG. 14A is a top view looking in the direction of the negative z-axis, whereas FIG. 14B is a front view looking in the direction of the positive y-axis (up-slope), and FIG. 14C is a magnified portion of FIG. 14B. Elements in these figures having the same reference number refer to the same part, component, or feature.

The load support structure 1430 is shown to be mounted on the very same metal panel roof as in FIGS. 13A-C. Accordingly, the ribs 1322*a-c*, panel flats 1324*a-d*, and purlin 1318 described above are repeated in FIGS. 14A-C, with no further explanation of those items being needed. Furthermore, the load support structure 1430 incorporates the above-described side rails 1384L, 1384R, with their upper flanges 1388L, 1388R, and thus no further explanation is needed of these elements either.

The lower closure 1460 includes a lower flange 1462 (with left and right halves 1462L, 1462R), a cover structure 1474, an upstanding element 1464 (with lower left, lower right, and upper portions 1464L, 1464R, 1464U), and an upper flange 1470. The lower flange 1462 is substantially flat and is secured against the panel flats of the underlying roof panels. The lower flange 1462 is actually in the form of two mirror image halves on opposite sides of the central raised rib 1322*b*. In that regard, the lower closure 1460 may be the combination or union of three separate members—an upper portion 1468, a lower left portion 1466L, and a lower right portion 1466R which may be a substantial mirror image of portion 1466L-which are held together by tabs and fasteners or by other suitable means. Splitting the lower closure 1460 into these separate members can make the installation procedure easier.

The lower closure 1460 also includes an upstanding element 1464 which provides an upstanding wall oriented parallel to the x-z plane and perpendicular to the lower flange 1462, and which may comprise a lower left portion 1464L, a lower right portion 1464R which may be a substantial mirror image of the portion 1464L, and an upper portion 1464U. The upstanding element 1464 terminates via a bend at its upper edge to form the upper flange 1470. The upper flange 1470 and the upstanding element 1464 thus each extends across the entire width of the opening 1326.

The upper flange 1470 of the lower closure 1460 adjoins upper flanges 1388L, 1388R of the side rails 1384L, 1384R, which in turn adjoin the upper flange of the upper diverter (not shown in FIGS. 14A-C) to form an uppermost rectangular frame-like flange on which a skylight or other load can rest.

In the central area of the lower closure 1460, a cover structure 1474 adjoins and connects the two halves of the lower flange 1462 and the two upstanding element portions 1464L, 1464R. The cover structure 1474 is much simpler in design than cover structure 1374 of FIGS. 13A-C due to the presence of adapter plug 1478. Thus, despite the fact that the raised rib 1322*b* of FIGS. 14A-C is identical to that of FIGS. 13A-C, the cover structure 1474 may consist only of, or consist essentially of, a left cover element 1472L and a right cover element 1472R that are each flat and oriented to form an inverted V-shaped cover structure 1474 as shown. The included angle between the cover elements 1472L, 1472R may be about 90 degrees, or in a range from 80 to 100 degrees, or any other suitable value. The cover structure 1474 covers and encloses an end portion of the central raised rib 1322*b*, but it does not conform to the contours and shape of the rib itself. Rather, the adapter plug 1478 is provided as an interface between the metal walls of the lower closure 1460 and the particular shape or profile of the raised rib 1322*b*.

The adapter plug 1478 has an outer surface 1481 and an inner surface 1479, the outer surface 1481 having an outer profile 1482, and the inner surface 1479 having an inner profile 1480. The cover structure 1474 of the lower closure 1460 substantially conforms to substantially all of, or to at least part of, the outer surface 1481 of the adapter plug, as shown in FIGS. 14B and 14C. The inner profile 1480 of the adapter plug substantially conforms to substantially all of, or to at least part of, the rib profile, as also shown in FIGS. 14B and 14C. The adapter plug 1478 is substantially smaller in size and weight than the remainder of the lower closure 1460, and it is preferably made of the same materials as those discussed above in connection with adapter plugs 650, 750, etc. In fact, whichever type of adapter plug is used with the upper diverter is also preferably used with the lower closure, or at least for the central area or region of the lower closure proximate the central raised rib 1322*b*. This is made possible by configuring the cover structure for the upper diverter (e.g. cover structures 646, 746 described above) in the same way as the cover structure for the lower closure (e.g. cover structure 1474 described above), for example by tailoring the respective pairs of cover elements to have substantially the same dimensions and substantially the same included angle between the elements.

The lower closure of FIGS. 13A-C conforms not only to both the left and right sides of the central raised rib 1322*b* but also to the right side of the raised rib 1322*a*, and to the left side of the raised rib 1322*c*, as best seen in FIG. 13B. Thus, in order to make the lower closure 1460 truly interchangeable and useable on any metal panel roof, the lower closure 1460 is provided with a left cover structure 1474L and a right cover structure 1474R in addition to the centrally located cover structure 1474 that has just been described. At the left end of the lower closure 1460, an adapter plug 1478L is provided to conform on its inner surface to the right half of the profile of raised rib 1322*a* (as seen in FIG. 14B), and on its outer surface to the left cover structure 1474L. At the right end of the lower closure 1460, an adapter plug 1478R is provided to conform on its inner surface to the left half of the profile of raised rib 1322*c* (as seen in FIG. 14B), and on its outer surface to the right cover structure 1474R. Since the rib profiles of ribs 1322*a, b, c* are all substantially the same, the adapter plug 1478L may be substantially identical to the right half of the adapter plug 1478, and the adapter plug 1478R may be substantially identical to the left half of the adapter plug 1478. Furthermore, the left cover structure 1474L may be substantially identical to the cover element 1472R, and the right cover structure 1474R may be substantially identical to the cover element 1472L.

Use of the adapter plugs 1478, 1478L, 1478R and associated cover structures allows the larger, heavier, more expensive (metallic) lower closure 1460 to be a standardized component that need not be specially adapted for a given raised rib profile shape, but that can be used on any type of raised rib roof by simply replacing the adapter plugs 1478, 1478L, 1478R with other such plugs whose inner surfaces are suitably tailored to conform to the different style of raised rib.

The lower closure 1430 may be mounted on the roof such that its upstanding element 1464 is nominally 5 inches from the centerline of the purlin 1318 as shown in FIG. 14A, but other values for this dimension may also be used as required for the particular installation.

Figure 15:
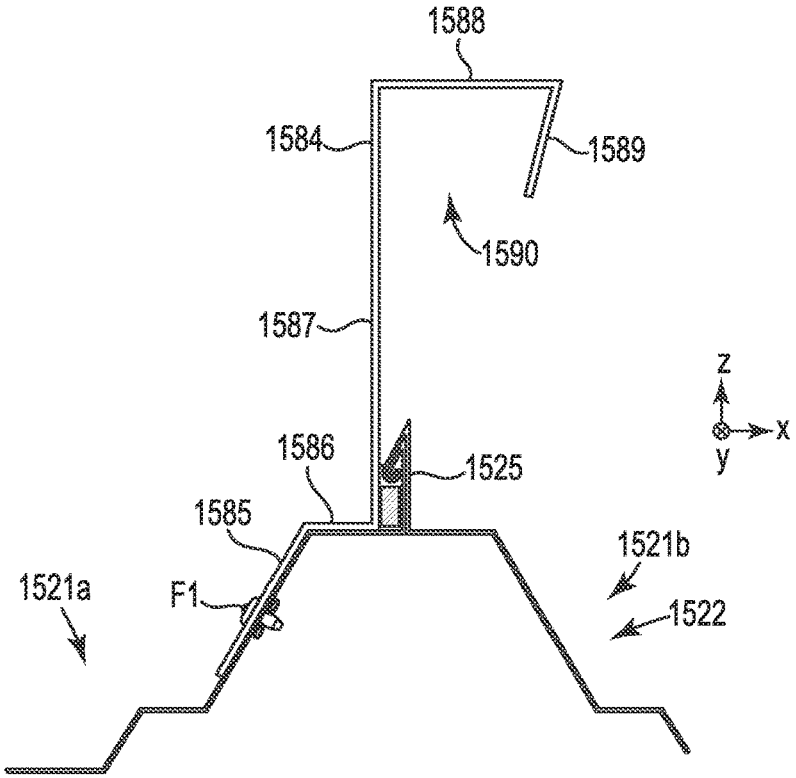
FIG. 15 is a schematic cross-sectional view of a side rail and neighboring roof elements suitable for use with the disclosed load support structures, such as would be seen along line 15-15 in FIG. 4.

Turning now to FIG. 15, we see there a schematic cross-sectional view of a side rail and neighboring roof elements suitable for use with the disclosed load support structures, such as would be seen along line 15-15 in FIG. 4. Thus, edge portions of roof panels 1521*a*, 1521*b* are sealed together along a standing seam 1525 and roll-formed to form a raised rib 1522, which may for example correspond to the raised rib 422*a* in FIG. 4. To this raised rib 1522 is attached a side rail 1584, e.g. by means of rivets, screws, or other suitable fasteners F1 which attach to an elevated portion of the raised rib rather than to a panel flat. The side rail may be of any suitable design. The particular side rail 1584 shown in the figure includes an inclined segment 1585, a shoulder segment 1586, an upstanding segment 1587, an upper flange 1588, and a return segment 1589. The return segment 1589 and neighboring portions of the rail 1584 define a cavity 1590 which can be used to hold insulation as shown further below. The side rail 1584 preferably extends and contacts the raised rib 1522 along substantially the entire length of the roof aperture or load support structure, e.g., approximately 9 feet in some embodiments as shown in FIG. 4. Such extended contact helps distribute the weight of the load over a large portion of the roof.

The upper flange 1588 of side rail 1584 may correspond substantially to the upper flange 488L of FIG. 4 and corresponding side rail flanges shown in other figures herein. The upper flanges of the left and right side rails of a given load support structure adjoin the upper flanges of the upper diverter and lower closure to form an uppermost rectangular frame-like flange on which a skylight or other load can rest.

Figure 16:
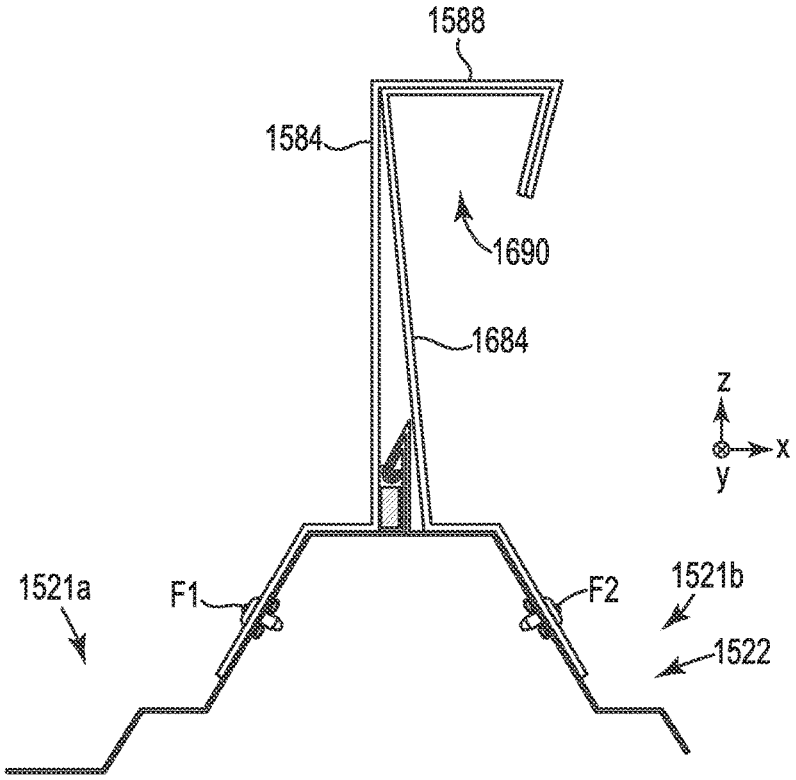
FIG. 16 is a schematic cross-sectional view of an alternative side rail and neighboring roof elements.

The side rail 1584 attaches to and contacts one side of a given raised rib. An alternative (composite) side rail which attaches to both sides of the raised rib is shown in FIG. 16. One part of the composite side rail is the previously described side rail 1584, which is labeled as such and requires no further explanation. Added to this is another side rail 1684 which has segments that attach to the opposite side of the raised rib 1521*b*, and segments that may snap fit or press fit at the underside of the upper flange 1588, thus creating a slightly modified cavity 1690. The combination of the rails 1584, 1684 provide a composite side rail for added support and strength which can be used in any of the embodiments described herein. The rail 1684 may be made of the same or similar material as the rail 1584, e.g., aluminum, steel, or another suitable metal. Alternatively, the rail 1684 may be made of a lower thermal conductivity material such as plastic, such that the rail 1684 acts as a thermal break or insulator (preventing warm moist air from the interior of the building from making contact with the rail 1584) in addition to its function of mechanical support.

Figure 17:
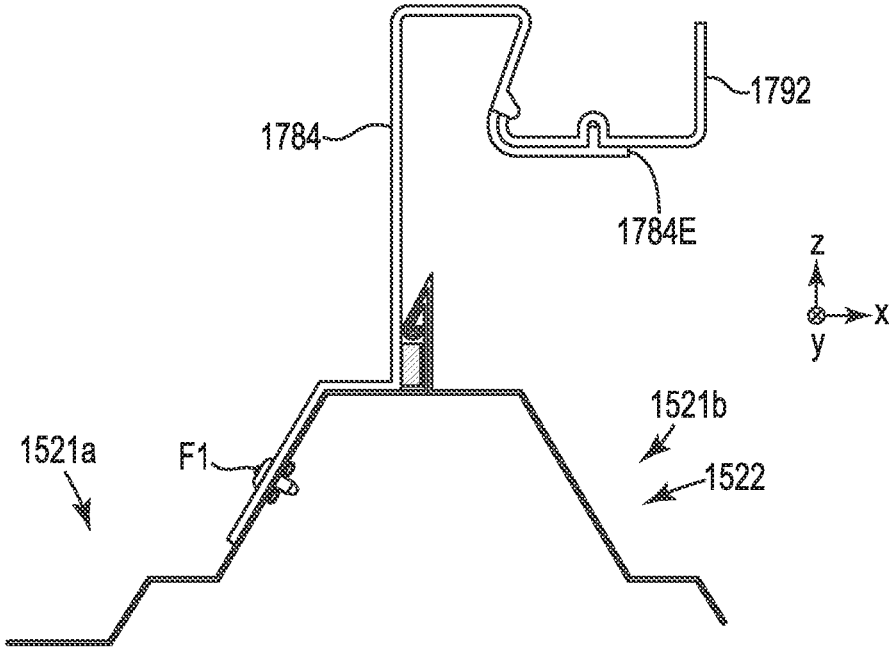
FIG. 17 is a schematic cross-sectional view of still another side rail and neighboring roof elements.

Still another type of side rail 1784 useable with the disclosed embodiments is shown in FIG. 17. The side rail 1784 is similar to side rail 1584 but has an additional bend to form a horizontal segment which terminates at a distal edge 1784E. The side rail 1784 also then includes two small protuberances, stops, or flanges to permit a complementary-shaped thermal break segment 1792 to press-fit or snap-fit in place near the top of the side rail 1784 as shown. Typically, the side rail 1784 is made of aluminum or another suitable metal, while the thermal break segment 1792 is made of a plastic material with a much lower thermal conductivity than aluminum. Further description of these and related components can be found in U.S. Pat. No. 9,228,354 (McClure).

Some metal buildings employ roofing insulation and/or moisture barrier sheeting above the rafters and beneath the roof panels. For such buildings, FIGS. 18 and 19 illustrate different ways the insulation and/or moisture barrier can be manipulated and terminated at the boundary of the roof opening along the left and right sides of a load support structure.

Figure 18:
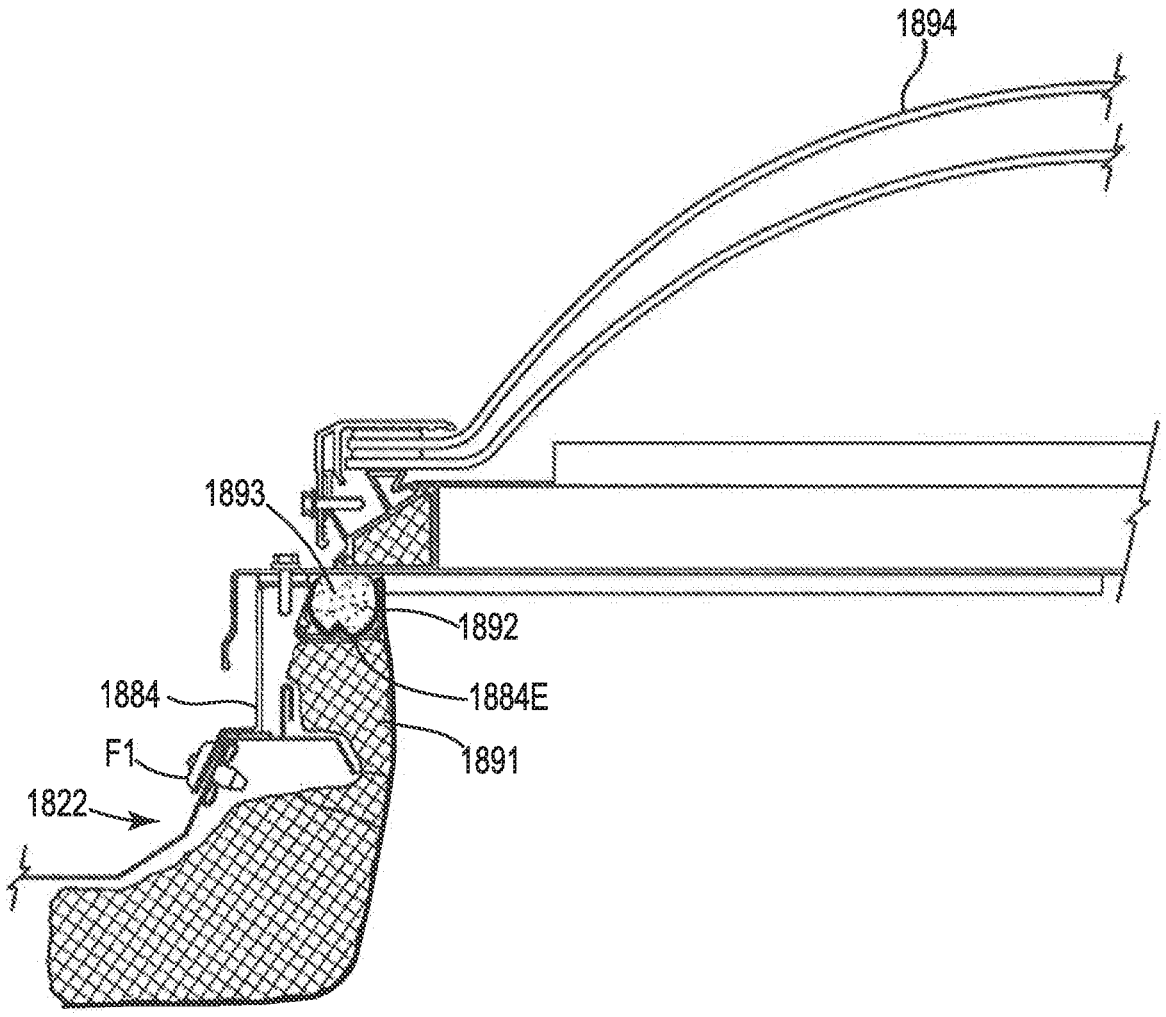
FIG. 18 is a schematic cross-sectional view of a portion of a load support structure with a skylight mounted thereon and neighboring roof elements, showing a thermal insulation termination technique.

In FIG. 18, one side of a load support structure is shown, where a side rail 1884 is attached to a raised rib 1822 with a fastener F, in accordance with other disclosed embodiments. The side rail 1884, which may be the same as or similar to the side rail 1784 described above, supports a load which includes a domed skylight 1894. For reduced condensation, a thermal break segment 1892 made of a low thermal conductivity material such as polyvinyl chloride (PVC) snap fits or otherwise attaches to the upper extremity of the side rail 1884. The side rail 1884, typically made of higher thermal conductivity material such as extruded aluminum or another suitable metal, has a terminal edge at 1884E, and the thermal break segment 1892 extends beyond this, farther into the roof opening. The thermal break segment 1892 and the side rail 1884 form a pocket within which can be placed an insulating rod 1893. The insulating rod 1893 may be slightly oversized such that it compresses under the load to provide an airtight seal. Faced insulation 1891, or other suitable insulation, can be wrapped upward from below, with the facing wrapped around and held in place by the insulating rod 1893 as shown in the figure. The wrapped insulation 1891 may thus completely cover the raised rib 1822 as well as the side rail 1884 and the side rail terminal edge 1884E, insulating those parts from relatively warmer and moister air circulating in the interior of the building, thus reducing condensation problems. Further details of this insulation technique and related information can be found in the '354 McClure patent referenced above.

Figure 19:
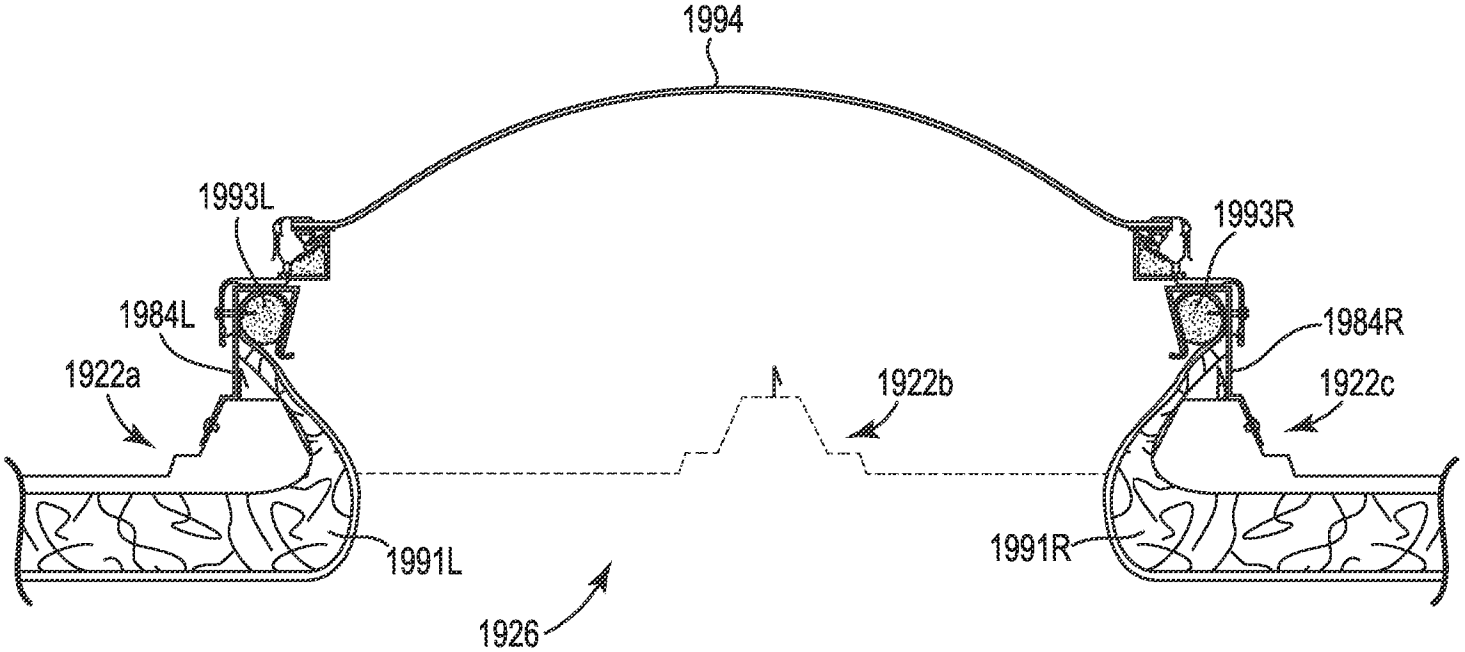
FIG. 19 is a schematic cross-sectional view similar to FIG. 18 but showing another thermal insulation termination technique.

An alternative approach for dealing with roofing insulation and/or moisture barrier at the edges of a load support structure is shown in FIG. 19. Here, a load support structure surrounds a roof opening or aperture 1926 on a metal panel roof, and supports a load such as a domed skylight 1994. To create the opening, a portion of a central raised rib 1922*b*, along with other roof panel portions, were cut away. A side rail 1984L attaches to a raised rib 1922*a*, and an opposed side rail 1984R attaches to a raised rib 1922*c*. Resilient foam retaining rods 1993L, 1993R are press-fit within the cavities formed by the upper segments of the side rails. Wrapped insulation or other insulation material 1991L, 1991R is wrapped upward on each side of the opening 1926 and held in place proximate the rods 1993L, 1993R respectively. The insulation 1991L, 1991R may completely cover the raised ribs 1922*a*, 1922*c* and part of the side rails 1984L, 1984R so as to provide insulation from relatively warmer and moister air circulating in the interior of the building. Further details of this insulation technique and related information can be found in U.S. Pat. No. 10,352,048 (Pendley et al.).

Figure 20:
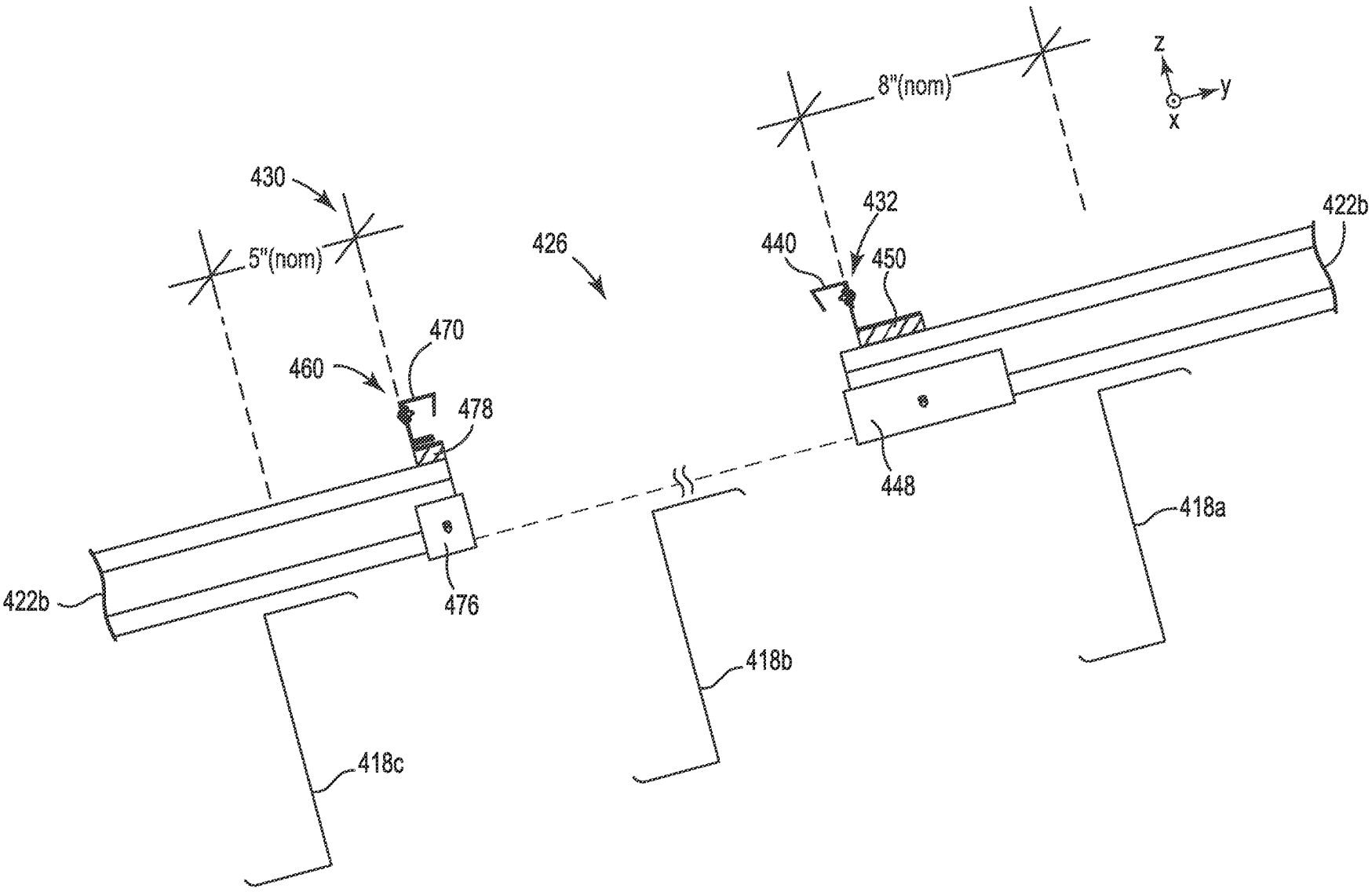
FIG. 20 is a schematic cross-sectional view of a load support structure and neighboring roof elements such as would be seen along line 20-20 of FIG. 4.

A schematic view along line 20-20 of FIG. 4 is provided in FIG. 20 to show another view of an exemplary load support structure and associated roof members. In this figure, portions of the load support structure 430 can be seen, namely, the upper diverter 432 and the lower closure 460, located on opposite sides of the roof opening 426. The opening 426 is located between the purlins 418*a*, 418*c*, with preferred dimensions relative to the purlin centerlines shown in the figure. The central raised rib 422*b* is of course absent in the opening 426, and the terminated ends are supported in a cantilevered fashion by the respective purlins. At the upper diverter 432, an upper flange 440, stiffener plate 448, and portion of an adapter plug 450 can be seen. At the lower closure, an upper flange 470, stiffener plate 476, and portion of an adapter plug 478 can be seen.

Unless otherwise indicated, all numbers expressing quantities, measured properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings herein. Not to limit the application of the doctrine of equivalents to the scope of the claims, each numerical parameter should at least be construed in light of the number of reported significant digits and by applying ordinary rounding techniques.

The use of relational terms such as "top", "bottom", "upper", "lower", "above", "below", and the like to describe various embodiments are merely used for convenience to facilitate the description of some embodiments herein. Notwithstanding the use of such terms, the present disclosure should not be interpreted as being limited to any particular orientation or relative position, but rather should be understood to encompass embodiments having any suitable orientations and relative positions, in addition to those described above.

Various modifications and alterations of this invention will be apparent to those skilled in the art without departing from the spirit and scope of this invention, which is not limited to the illustrative embodiments set forth herein. Features of one disclosed embodiment can also be applied to all other disclosed embodiments unless otherwise indicated. All U.S. patents, patent application publications, and other patent and non-patent documents referred to herein are incorporated by reference, to the extent they do not contradict the foregoing disclosure.

The invention claimed is:

1. A load support structure for mounting a load on a metal panel roof in which elongate metal roof panels are arranged side by side, with edges of adjacent roof panels being joined to each other to define elevated roof panel ribs, and panel flats of the roof panels extending between adjacent ones of the elevated ribs, the roof panel ribs including a second roof panel rib disposed between a first and a third roof panel rib, the first, second, and third ribs all having a same rib profile, the load support structure comprising:

an upper diverter and a lower closure, each adapted to extend from the first rib to the third rib;

a first side rail and a second side rail, each adapted to extend from the upper diverter to the lower closure; and a first adapter plug having a first outer surface and a first inner surface, the first outer surface having a first outer profile, and the first inner surface having a first inner profile;

wherein the upper diverter includes a lower flange, a first inclined element, a second inclined element, and an upstanding element, the first and second inclined elements each connecting the lower flange to the upstanding element but on opposite ends of the upper diverter;

wherein the upper diverter further includes a first cover structure disposed between the first and second inclined elements;

wherein the first cover structure substantially conforms to at least part of the first outer surface of the first adapter plug; and wherein the first inner profile of the first adapter plug substantially conforms to at least part of the rib profile.

2. The structure of claim 1, wherein the first outer surface of the first adapter plug has one or more first edges and the first inner surface of the first adapter plug has a plurality of second edges, the one or more first edges and the plurality of second edges being parallel to each other.

3. The structure of claim 1, wherein the first outer surface of the first adapter plug has one or more first edges and the first inner surface of the first adapter plug has a plurality of second edges, the plurality of second edges being greater in number than the one or more first edges.

4. The structure of claim 1, wherein the first cover structure comprises a first cover element and a second cover element with a gap therebetween, and the first adapter plug includes a first cap portion, and the first cap portion extends through the gap.

5. The structure of claim 4, wherein the first cap portion defines a first slot, and an edge of the first cover element mates with the first slot.

6. The structure of claim 1, wherein the first adapter plug comprises rubber or Ultra High Molecular Weight (UHMW) polyethylene.

7. The structure of claim 1, wherein the upper diverter includes a first diverter member and a second diverter member, the first diverter member adapted to extend from the first rib to the second rib, and the second diverter member adapted to extend from the second rib to the third rib, the first diverter member including the first inclined element, and the second diverter member including the second inclined element.

8. The structure of claim 7, wherein the first and second diverter members are joined to each other by one or more mechanical fasteners.

9. The structure of claim 7, wherein the first cover structure includes a first cover element and a second cover element, the first diverter member including the first cover element, and the second diverter member including the second cover element.

10. The structure of claim 9, wherein the first and second cover elements are each flat but are not parallel to each other.

11. The structure of claim 10, wherein the first and second cover elements are oriented to define an included angle in a range from 80 to 100 degrees.

12. The structure of claim 9, wherein the first and second cover elements each extend in a direction perpendicular to the upstanding portion.

13. The structure of claim 1, further comprising:

a second adapter plug having a second outer surface and a second inner surface, the second outer surface having a second outer profile, and the second inner surface having a second inner profile;

wherein the lower closure includes a second cover structure, the second cover structure substantially conforming to at least part of the second outer surface of the second adapter plug; and wherein the second inner profile of the second adapter plug substantially conforms to at least part of the rib profile.

14. The structure of claim 13, wherein the second inner profile is substantially the same as the first inner profile.

15. The structure of claim 13, wherein the second outer surface of the second adapter plug has one or more first edges and the second inner surface of the second adapter plug has a plurality of second edges, the one or more first edges and the plurality of second edges being parallel to each other.

16. The structure of claim 13, wherein the second outer surface of the second adapter plug has one or more first edges and the second inner surface of the second adapter plug has a plurality of second edges, the plurality of second edges being greater in number than the one or more first edges.

17. The structure of claim 13, further comprising:

a third adapter plug having a third outer surface and a third inner surface, the third outer surface having a third outer profile, and the third inner surface having a third inner profile; and a fourth adapter plug having a fourth outer surface and a fourth inner surface, the fourth outer surface having a fourth outer profile, and the fourth inner surface having a fourth inner profile;

wherein the lower closure includes a third cover structure and a fourth cover structure, the third cover structure substantially conforming to at least part of the third outer surface of the third adapter plug, and the fourth cover structure substantially conforming to at least part of the fourth outer surface of the fourth adapter plug.

18. The structure of claim 17, wherein the second inner profile substantially conforms to two sides of the rib profile, and each of the third and fourth inner profiles substantially conforms to only one side of the rib profile.

19. A load support structure for mounting a load on a metal panel roof in which elongate metal roof panels are arranged side by side, with edges of adjacent roof panels being joined to each other to define elevated roof panel ribs, and panel flats of the roof panels extending between adjacent ones of the elevated ribs, the roof panel ribs including a second roof panel rib disposed between a first and a third roof panel rib, the first, second, and third ribs all having a same rib profile, the load support structure comprising:

an upper diverter including a first diverter member and a second diverter member, the first diverter member adapted to extend from the first rib to the second rib and the second diverter member adapted to extend from the second rib to the third rib;

a lower closure including a first closure member and a second closure member, the first closure member adapted to extend from the first rib to the second rib and the second closure member adapted to extend from the second rib to the third rib;

a first side rail and a second side rail, each adapted to extend from the upper diverter to the lower closure; and a first adapter plug having a first outer surface and a first inner surface, the first outer surface having a first outer profile, and the first inner surface having a first inner profile;

wherein the first diverter element includes a first upstanding portion, a first inclined element, and a first cover element;

wherein the second diverter member includes a second upstanding portion, a second inclined element, and a second cover element;

wherein the first cover element in combination with the second cover element substantially conform to at least part of the first outer profile of the first adapter plug; and wherein the first inner profile of the first adapter plug substantially conforms to at least part of the rib profile.

20. A load support structure for mounting a load on a metal panel roof that includes regularly spaced raised ribs, the ribs including a second rib disposed between a first and a third rib, the first, second, and third ribs all having a same rib profile, the load support structure comprising:

a first transverse member and a second transverse member, each adapted to extend from the first rib to the third rib;

a first side rail and a second side rail, each adapted to extend from the first transverse member to the second transverse member; and an adapter plug having an outer surface and an inner surface, the outer surface having an outer profile, and the inner surface having an inner profile;

wherein the first transverse member includes a cover structure that substantially conforms to at least part of the outer surface of the adapter plug; and wherein the inner profile of the adapter plug substantially conforms to at least part of the rib profile.

21. The structure of claim 20, wherein the first transverse member comprises an upper diverter, and the second transverse member comprises a lower closure.

* * * * *